United States Patent [19]

Kamp

[11] Patent Number: 4,844,358

[45] Date of Patent: Jul. 4, 1989

[54] AUTOMATIC CROSS-WOUND BOBBIN WINDING MACHINE

[75] Inventor: Heinz Kamp, Wegberg, Fed. Rep. of Germany

[73] Assignee: W. Schlafhorst & Co., Mönchengladbach, Fed. Rep. of Germany

[21] Appl. No.: 76,690

[22] Filed: Jul. 22, 1987

[30] Foreign Application Priority Data

Jul. 23, 1986 [DE] Fed. Rep. of Germany ..... 3624904

[51] Int. Cl.[4] ..... B65H 54/20

[52] U.S. Cl. ..... 242/35.5 R; 242/35.5 A; 242/35.6 R

[58] Field of Search ..... 242/35.5 R, 35.5 A, 242/35.6 R, 18 R

[56] References Cited

U.S. PATENT DOCUMENTS

| | | | |
|---|---|---|---|
| 2,045,872 | 6/1936 | Reiners et al. | 242/35.5 R |
| 2,908,029 | 10/1959 | Furst | 242/35.5 R X |
| 3,033,478 | 5/1962 | Furst | 242/35.6 R |
| 3,198,446 | 8/1965 | Furst et al. | 242/35.6 R |
| 3,834,634 | 9/1974 | Havlas et al. | 242/35.5 R X |
| 3,951,350 | 4/1976 | Uchida | 242/35.5 A |
| 4,319,720 | 3/1982 | Ueda | 242/35.5 R |
| 4,463,909 | 8/1984 | Kiriake et al. | 242/35.5 A |
| 4,541,578 | 9/1985 | Kawarabashi et al. | 242/35.5 A |
| 4,589,602 | 5/1986 | Reiners et al. | 242/35.5 R |

FOREIGN PATENT DOCUMENTS

| | | |
|---|---|---|
| 1131844 | 6/1962 | Fed. Rep. of Germany . |
| 1267155 | 4/1968 | Fed. Rep. of Germany . |
| 1989361 | 7/1968 | Fed. Rep. of Germany . |
| 1760988 | 1/1972 | Fed. Rep. of Germany . |
| 2316452 | 10/1974 | Fed. Rep. of Germany . |
| 2455892 | 6/1975 | Fed. Rep. of Germany . |
| 7532476 | 2/1976 | Fed. Rep. of Germany . |
| 1926310 | 2/1980 | Fed. Rep. of Germany . |
| 2939481 | 7/1980 | Fed. Rep. of Germany . |
| 3009714 | 9/1980 | Fed. Rep. of Germany . |
| 2945504 | 5/1981 | Fed. Rep. of Germany . |
| 3213631 | 10/1982 | Fed. Rep. of Germany . |
| 3318435 | 11/1984 | Fed. Rep. of Germany . |
| 3149206 | 2/1986 | Fed. Rep. of Germany . |
| 87738 | 11/1972 | German Democratic Rep. . |

*Primary Examiner*—Stanley N. Gilreath

*Attorney, Agent, or Firm*—Herbert L. Lerner; Laurence A. Greenberg

[57] ABSTRACT

An automatic cross-wound bobbin winding machine includes a supporting frame and a plurality of winding devices secured on the supporting frame. Each of the winding devices includes pre-assembled modular structural units each having individual parts in the form of at least a yarn run-off location for a run-off spool, a yarn tensioner, a yarn joining device, and a cross-wound bobbin winding mechanism. A plurality of the structural units are combined into standardized or model-specific pre-assembled structural assemblies. Each of the structural units and each of the structural assemblies have pre-readied fastening devices for interchangeable clamping to an adjacent structural unit or structural assembly in an accurate position.

46 Claims, 10 Drawing Sheets

AUTOMATIC CROSS-WOUND BOBBIN WINDING MACHINE

The invention relates to an automatic cross-wound bobbin or cheese winding machine that is easily refittable without using a special tool and without special skills. The setting may be in terms of the length, the diameter, the yarn crossing angle and the conicity of the cross-wound bobbins or cheeses to be wound. It may also be in terms of the number of winding locations, in terms of the material, type and thickness of the yarns to be wound, in terms of the manner in which flaws in the yarn are eliminated and in terms of the manner in which two yarn ends are joined, in a corresponding variety of model types. The machine includes a supporting frame. A plurality of winding devices secured on the supporting frame each have a yarn run-off location for the run-off spool, a yarn tensioner, a yarn joining device, a cross-wound bobbin or cheese winding mechanism, a yarn cleaner and/or yarn monitor. A run-off spool magazine may also be present.

A winding machine of this kind has not been known heretofore. In the prior art it has always been difficult to refit a machine and it has been necessary to use special tools requiring special skills to do so.

It is accordingly an object of the invention to provide an automatic cross-wound bobbin or cheese winding machine, which overcomes the hereinafore-mentioned disadvantages of the heretofore-known devices devices of this general type and in particular such a machine which can be refitted easily for a great variety of models, without using special tools and without special skills. It is also an object of the invention to replace as few individual parts as possible during the refitting and therefore to assure that the time required for the refitting remains short. Finally, the inventory of parts in terms of the number of parts should be limited, without having to sacrifice great variety in terms of types of compact automatic cross-wound bobbin or cheese winding machines and in terms of the operation conditions.

With the foregoing and other objects in view there is provided, in accordance with the invention, an automatic cross-wound bobbin winding machine. The machine includes a supporting frame. A plurality of winding devices are secured on the supporting frame. Each of the winding devices includes pre-assembled modular structural units each having individual parts in the form of at least a yarn run-off location for a run-off spool, a yarn tensioner, a yarn joining device, a cross-wound bobbin winding mechanism, a yarn cleaner and/or a yarn monitor and optionally a run-off spool magazine. A plurality of the structural units are combined into standardized or model-specific pre-assembled structural assemblies. Each of the structural units and each of the structural assemblies have pre-readied fastening means, position-fixing means and/or couplings for energy supply means for interchangeable clamping to an adjacent structural unit or structural assembly in an accurate position.

The invention relates to an automatically operating cross-wound bobbin or cheese winding machine, to which the run-off spools, in the simplest case, are fed by hand into a run-off spool magazine. The removal of the run-off spools required in succession is taken care of automatically by the winding machine. The yarn status is monitored continuously during winding and yarn cleaning takes place in the case of an improper yarn status; that is, the flaw is removed from the yarn. The result is the finished cross-wound bobbin or cheese, which in the simplest case is removed by hand and replaced with an empty spool tube. This activity as well can be included in the automation. To this end, a movable or drivable spool charger will then be used.

The spools are deposited into a trough, or onto a conveyor belt, which is switched on from one instant to another and the finished cross-wound bobbins or cheeses are then conveyed to one end of the machine, where they can be removed and placed into shipping means, for instance.

Each individual structural unit of the cross-wound bobbin or cheese winding machine is as a rule composed of a plurality of individual parts. The size of one structural unit is not only a product of the functional relationship of its parts, but also of the consideration as to which individual parts can be combined into a proper structural unit in view of the goal of obtaining the desired variety of models by simple refitting. If no other factors militate against it, then the attempt is made to form the largest possible structural units. However, this attempt can be limited by transport problems, problems of storage and problems of easy handling. Any desired models of the automatic cross-wound bobbin or cheese winding machine can be manufactured from the arsenal of structural units thus formed.

It is suitable for the purpose of the invention if a plurality of units are combined into either standardized or model-specific pre-assembled structural assemblies. Thus depending on the model, such assemblies may each have a somewhat different composition. Standardized assemblies could also be called structural units, because they would be usable for all model types of the machine. However, it is not mandatory that all structural units of the cross-wound bobbin or cheese winding machine be combined into preassembled assemblies. There are also structural units that cannot be combined well into structural assemblies and in an individual case it may even be unsuitable to form a pre-assembled assembly from certain units.

However, it is suitable for the purpose of the invention to pre-ready each unit and each assembly for mutual positionally accurate clamping with an adjacent unit or assembly. To this end, fastening means, position-fixing means and/or couplings for energy supply means are used. For instance, the fastening means may be stops, threaded bores, bolts or the like; position-fixing means may likewise be stops, but may also be alignment pins, alignment bores or the like. Possible energy supply means are, for instance, pipelines for transmitting pneumatic energy, or hydraulic energy in general, and electrical lines for transmitting electrical energy. Other energy supply means, such as fiber-optic wave guides for example, would also be conceivable. For the specific energy supply means to be selected, the couplings will already be present on the structural units and assemblies, so that refitting need not be further disrupted and hindered by the need to lay lines or the like.

Thus all in all a modular principle is utilized, in the intent of making all the parts insertible into one another to the extent possible. The connection points are suitably located wherever a separating point is considered favorable for the purpose of the desired change of model. In the novel machine, this also dictates a novel subdivision into structural assemblies especially suitable for this purpose. Thus the structural units of the support frame form a frame assembly, in which the number of units depends on the number of winding devices. This frame assembly is thus model-specific in the sense that the entire support frame is capable of being lengthened, for example in assemblies of 10 winding devices at a time. For example, if a total of only 10 winding devices is provided on the cross-wound bobbin or cheese winding machine, then the frame assembly will also have only 10 connection locations for them and the entire support frame is correspondingly short. On the other hand, if 2 or 3 times 10 winding devices are provided, then the frame assembly will be correspondingly longer as a result of the joining together of units.

The structural units of the winding device are subdivided into a yarn feed assembly and a yarn take-up assembly. This subdivision has the following advantage, among others: Entirely different yarns can be fed, in the form of largely identical runoff spools. The yarn feed assembly accordingly need not be changed, even if changes need to be performed in the yarn take-up assembly, for instance because cylindrical spools of great length are to be wound at one time, conical spools of great conicity at another time, narrow spools of large diameter at yet another time and spools having a yarn crossing angle that is different from the standard are to be wound at still another time. Conversely, only the yarn feed assembly needs to be refitted whenever the same cross-wound bobbins or cheeses are to be made but the run-off spools that are to be fed are quite different in terms of their dimensions.

The yarn feed assembly includes, inter alia, the yarn runoff location and optionally the run-off spool magazine. The yarn take-up assembly includes, inter alia, at least the yarn tensioner, the yarn joining device, the yarn cleaner and the cross-wound bobbin or cheese winding mechanism as its structural units. However, this is not intended to be an exhaustive listing of the structural units united from one instance to another in the structural assemblies.

Advantageously, the frame assembly has at least a front end frame and optionally a rear end frame as well and a frame kit serving to support the winding devices. Further frame kits can be connected to the first frame kit, their number depending on the number of winding devices. The frame kit has side walls, which are joined in a stabilizing manner by horizontal statically loadable traverses and one suction conduit section. The suction conduit section can itself be statically loadable and may support other parts, but this is not always necessary. The traverses and optionally the suction conduit section as well, stabilize the frame assembly and support the winding devices.

For the sake of stability, a certain suitable length of the frame kit should not be exceeded. In practice, such a frame kit has a maximum length such that it is capable of supporting 10 winding devices located beside one another. The number of winding devices doubles if the front end frame is joined to a first frame kit and this kit is joined by a further frame kit to the rear end frame. Lengthening by 10 winding devices at a time is possible if further frame kits are introduced into the frame assembly. A separate end frame can be dispensed with under some circumstances.

The frame assembly is pre-readied as much as possible for the assembly of cross-wound bobbin or cheese winding machines of different lengths. To this end, it has at least one compressed air supply device, one suction air supply device, one control device and at least one switching and supply device for electrical energy as further structural units, optionally in one of the end frames.

Generally, it is advantageous for the aforementioned devices all to be accommodated together in one end frame, for example in the front end frame. For various reasons, however, this may be unsuitable in a given individual case, so that the devices can also be distributed among the front and rear end frames. However, since all these devices require electrical energy for their operation, the front end frame should contain as much of these devices as possible. It is then simpler to connect the supply lines. Later lengthening or shortening of the cross-wound bobbin or cheese winding machine also presents no connection problems in that case.

In a further development of the invention, the frame kit has at least one traverse formed of sheet metal, which has a box-like profile and optionally has a continuous, flat-machined reinforcement strip on one long side. The reinforcement strip may then have threaded bores for fastening and/or alignment pin bores for positional fixation of the yarn take-up assemblies, for instance. Traverses of sheet steel are very simple to make by beveling flat sheets. They need not be machined any further. Only the reinforcement strip, which may for example be welded on, is machined flat with a machine tool, so that structural elements and assemblies secured to it can be aligned perfectly. The fastening bores and alignment pin bores are likewise pre-readied by machine, so that a perfect alignment line results.

The individual yarn feed assemblies require separate holder means. To this end, according to a further development of the invention, the frame kit has at least one traverse for holding these yarn feed assemblies. These traverses also include fastening and position-fixing means. It is no longer necessary to have an individual positional fixation at the time a yarn feed assembly is mounted. The positional fixation is pre-readied at the factory. In the case of yarn travel from bottom to top, the traverses for holding the yarn feed assemblies are located in the lower portion of the support frame or frame assembly.

The intermediate walls may be formed of flat sheet-steel plates that are spaced apart from the adjoining wall, optionally by spacer elements, and are screwed together in a detachable manner. Such a construction has various advantages. Flat sheet-steel plates are available in industry in standardized dimensions and can be simply machined fully automatically, very accurately and true to dimension and they can be beveled as well, by computer-controlled stamping. The stability is increased by connecting with screws. At the same time, however, screw connection locations can serve as connection locations for the individual structural elements. According to a further development of the invention it is provided that the front end frame and one frame kit at a time, with one half of a separable intermediate frame as a side wall, forms one transportable structural assembly. In like manner, the rear end frame and one frame kit along with one half of a separable intermediate frame as a side wall forms a structural assembly that is movable separately. Further frame kits with intermediate frame halves as side walls can be disposed inbetween as transportable structural assemblies. These pre-assembled structural assemblies are combined, for instance, by screwing the two intermediate frame halves together, to form the complete frame assembly.

The frame assembly can also have a spool holding assembly and pre-readied fastening means and/or position-fixing means for retaining the spool holding assembly. The spool holding assembly may include a trough or a conveyor belt for receiving the completely wound cross-wound bobbins or cheeses. The fastening means and/or position fixing means are suitably disposed on the rear end frame, on the front end frame and optionally on the side walls or intermediate frames. The traverses need not bear the weight of the spool holding unit.

According to a further development of the invention, the cross-wound bobbin or cheese winding machine optionally has at least one blower assembly.

The frame assembly may have pre-readied fastening means and/or position-fixing means for holding the blower assembly. These fastening means and/or position-fixing machines also can be disposed on the rear end frame, on the front end frame and optionally on the side walls or intermediate frames. Advantageously, the blower assembly includes a movable blower unit and supporting units. The movable blower unit may be a fan, for instance, driven by an electric motor, in combination with blower nozzles. The supply of energy to the electric motor may be effected through a drag chain or through current rails. Each supporting unit advantageously includes at least one vertical support element and one horizontal beam. If the front end frame, the rear end frame and every intermediate frame each have a supporting element, then all of the horizontal beams have the same length.

Advantageously, the blower unit of the blower assembly has blower nozzles discharging above head height, which direct a curtain of blowing air against the front panel of the machine.

Good dust removal is attained in cooperation with a matched dust vacuuming device, without stirring up an unnecessarily large amount of dust.

Since it is advantageous to have the completely wound cross-wound bobbins or cheeses exchanged automatically for empty spool tubes, according to a further development of the invention, the cross-wound bobbin or cheese winding machine optionally has at least one movable automatic pre-readied guide means for the movable automatic cross-wound bobbin or cheese changer. Cross-wound bobbin or cheese changers are known per se. However, they are not used in all automatic cross-wound bobbin or cheese winding machines. For the sake of attaining the object of the invention, however, it is advantageous to provide for the possible use of a movable cross-wound bobbin or cheese changer from the outset. The guide means may, for instance, include a traveling rail connected to an upper traverse of the frame kit and a guide rail connected to the horizontal beam of the supporting unit of the blower assembly. The traveling rail and upper traverse mutually stabilize one another and the horizontal beam and the guide rail secured to it also mutually stabilize one another. This factor can already be taken into consideration in the dimensioning of these elements, which leads to economies in terms of material.

The most important parts of the automatic cross-wound bobbin or cheese winding machine are the yarn take-up assemblies. In refitting to some other model type, changes must very often be made in this yarn take-up assembly. However, it is not necessary to replace the entire yarn take-up assembly, if further embodiments of the invention are taken into account.

According to a further development of the invention it is provided that the yarn take-up assembly has a pre-assembled drive unit and that further device units are detachably secured to one wide side of this drive unit. This should be identical for all model types. When the model type is changed, not all the device units need to be replaced. Therefore, the device units are advantageously subdivided into standard units that are identical for all models of the cross-wound bobbin or cheese winding machine and model-specific device units that are constructed differently depending on the model type. For example, the standard units may include one yarn tensioner unit each, a lower pivot nozzle for aspiration of the lower yarn and subsequent placement of it into the yarn joining device, an upper pivot nozzle for aspirating the upper yarn and then placing it into the yarn joining device, a yarn waxing unit, the drive unit of a yarn joining device including this drive unit and a knotting unit or splicing unit, the drive unit of the cross-wound bobbin or cheese winding mechanism, and the cross-wound bobbin or cheese spool frame. The model-specific device units may include the knotting or splicing unit of the yarn joining device, the winding drum that guides the yarn and drives the cross-wound bobbin or cheese by friction, and the yarn cleaner. The yarn cleaner performs feeler functions, yarn separating functions and yarn clamping functions. In terms of the construction of the machine, these functions can be assigned to separate machine parts. In the strict sense, all that is necessary is to replace the particular feeler head performing the yarn feeling function. However, for the sake of simplicity, the entire yarn cleaner can also be replaced in the course of the refitting, if that should be necessary for a change of model.

Care is taken in the construction of the automatic cross-wound bobbin or cheese winding machine to keep the structural length of the machine as short as possible in accordance with prevailing conditions. It is therefore provided according to a further development of the invention that the drive unit has a flat housing, one narrow side of which has pre-readied fastening means and position-fixing means for mutual positionally accurate clamping to an upper traverse and a middle traverse of the frame kit. The fastening means and position-fixing means have already been discussed above. The aforementioned flat housing accordingly to protrudes outward toward the front from the traverses, and the aforementioned device units are detachably secured to its wide side. To a person standing in front of the winding machine, the device units are always located on either the left or right side of the housing. To place them on both sides is considered inefficient. It is preferable to locate them all in the same way, that is, either on the left or on the right.

The location of the individual drive units will now be discussed in further detail. To this end, it is provided according to a further development of the invention that the yarn tensioner unit protrudes from the lower housing part of the drive unit, below the yarn joining device and that it has a disk-type yarn brake with at leat one brake disk driven by a drive device.

In the yarn tensioner unit, care must always be taken, as in the case of the other device units as well, that the fastening means provided for the positionally accurate clamping, position-fixing means and/or couplings for energy supply means are present. Exemplary embodiments for these means have been discussed above. The yarn tensioner unit should be one and the same for all models of the cross-wound bobbin or cheese winding machine, but it must be considered among the parts subject to wear, because the disks of the yarn brake undergo wear depending on the type and duration of the winding operation. The same naturally applies for other mechanically moving parts of the yarn tensioner unit. For this reason, the problem-free refitting or replacement provided by the embodiment according to the invention is highly advantageous in this case as well.

Since the pivot nozzles primarily serve to place the ends of the yarn into the yarn joining device, it is of particular importance to provide a placement that permits pivoting of these pivot nozzles so that they can perform their task without having to dispense with the advantage of detachably securing these specialized device units on the wide side of the drive unit. It is therefore proposed according to a further development of the invention that the pivot path of the lower pivot nozzle extends from the yarn travel path below the yarn tensioner unit as far as a point above the knotting or splicing unit of the yarn joining device, and that the pivot plane of the pivot arm of the pivot nozzle is located between the housing of the drive unit and the splicing or knotting unit. Since the yarn joining device itself is detachably secured to the wide side of the housing of the drive unit, it is necessary for the aforementioned knotting or splicing unit to be allowed to protrude forward from the drive unit of the yarn joining device, while being spaced from the housing of the drive unit. In this way, a free space is created for the pivot plane of the pivot arm of the lower pivot nozzle.

According to a further development of the invention, the disposition of the upper pivot nozzle is defined in further detail as well. Prior to that, however, there should be a discussion of other device units.

Advantageously, the yarn waxing unit protrudes above the yarn joining device from the housing of the drive unit and is equipped with a drive device for a roll of paraffin.

Since the driven disk of the yarn brake always rotates whenever the roll of wax is also rotated about its longitudinal axis, the drive device of the yarn tensioner unit and the drive device of the yarn waxing unit can advantageously be connected to a common drive motor by means of at least one traction gear.

Since the yarn cleaner advantageously is also intended to perform the function of a yarn joining monitor, it is furthermore proposed that the yarn cleaner be disposed in the yarn path between the yarn tensioner and the yarn waxing unit above the yarn joining device.

Under all these preconditions, it is provided according to a further development of the invention that the pivot path of the upper pivot nozzle extends from a position located near the cross-wound bobbin or cheese to a point below the knotting or splicing unit of the yarn joining device, and that the pivot plane of the pivot arm of the pivot nozzle be located before the outer ends of the yarn waxing unit, the knotting or splicing unit and the yarn cleaner. The upper pivot nozzle thus pivots past all the aforementioned parts on the outside. It also has a relatively large pivot radius. It is also distinguished from the lower pivot nozzle in this respect. Due to all these provisions, the device units can be attached as quickly as desired to the wide side of the housing of the drive unit and in such a manner that they can be replaced without having to use a special tool.

In refitting the cross-wound bobbin or cheese winding machine, the energy supply lines should also not be allowed to be an obstacle. It is accordingly provided according to a further development of the invention that the housing of the drive unit has a suction air distributor to which the two pivot nozzles and a yarn catching nozzle disposed above the yarn waxing unit are connected. In refitting operations, the suction air distributor remains as it is. The suction conduit advantageously receives one connection element for each winding device, and the aforementioned suction air distributor is joined by means of a coupling tube to one of these connection elements at a time. A sturdy rubber hose that can be pushed into place by being slipped by hand onto a pipe connector functioning as a connection element, is sufficient as the coupling tube.

In order to pursue the above-outlined objective of the invention, the frame assembly can advantageously have at least one multi-contact outlet for each winding device, for the sake of supplying the drive motors with electrical energy, and the individual drive units can each have at least one multi-contact plug for this same purpose. Naturally, it is convenient to provide only a single multi-contact plug connection. However, for various reasons, this cannot always be done. Safety regulations for the individual voltage ranges may under some circumstances necessitate a plurality of multi-contact plug devices. A spatial separation of the plug connections will be necessary for the sake of separating the energy lines from the signal lines as well.

The yarn joining device advantageously has at least one detachable connecting device for connection to a compressed air distributor device of the frame kit. However, if the yarn joining device is provided with a splicing unit, then at least one compressed air connection is necessary to establish the spliced connection. However, there are also splicing devices that require not only the splicing air but also suction air or processing air for aspirating or pre-treating the yarn ends. Sincee the operating pressure and also the time and air quantity required for the splicing device vary, it can be advantageous to have two compressed air supply systems available that are separate from one another. Typically, two detachable connection devices are accordingly necessary for connection to the compressed air distributor device. In terms of the more-detailed embodiment of the proposed joining device, it should also be noted that in the simplest case the connection is produced by means of insertible compressed air hoses. This is a time-tested method. However, the supply of compressed air can also be guided through the housing of the drive unit and the compressed air connection can then be made from the housing. This would have the slight additional advantage that when the entire yarn joining device is changed, the connection to the compressed air distributor device would not need to be broken as well. However, in that case a plug connection for the compressed air connection is advantageously already present on the drive unit, in such a way that when the drive unit is secured to the housing, the connection to the compressed air supply is automatically made.

The protruding mounting of the device units on the wide side of the drive unit of the yarn take-up assembly can advantageously be exploited in order to increase the economy of the cross-wound bobbin or cheese winding machine by increasing the winding speed. Among other factors, the winding speed is known to depend on the angle of the jigging or oscillating triangle, which forms between a yarn guide point and the outer turning points of the reverse thread undercuts of the winding drum. This jigging triangle is typically narrowed from time to time in automatic cross-wound bobbin or cheese winding machines by a monitoring device which has the task of monitoring the status of the joint following a yarn joining operation. Due to the disposition of the device units according to the invention as mentioned above, care has already been taken to ensure that the yarn cleaner is also capable of performing the function of such a monitoring device. Since an angle of a maximum of 45° for winding a spool to a maximum width of 10 inches has been ascertained as a desirable jigging angle, it is provided according to a further development of the invention that a yarn eyelet is disposed above the yarn waxing unit, the eyelet being located approximately 25–35 cm from the central axis of the winding drum and having a center-to-center offset with respect to the winding drum of approximately 10 mm. As a result it is assured that the jigging angle will not deviate substantially from a maximum of 45°. At the same time, the center-to-center offset provides that so-called half windings are avoided. This term refers to a phenomenon in which the yarn or thread does not jig or oscillate over the entire width of the winding drum but only over half the width. This winding flaw is typically not even noticed at all, because winding is performed in alternation for a period of time only on the left half and then for another period of time only on the right half, so that under some circumstances the diameter is again equalized. Nevertheless, this makes the cross-wound bobbin or cheese uneven, which can justifiably be traced to the improper functioning of the cross-wound bobbin or cheese winding machine. The cause of this is to be found in the fact that in prior art cross-wound bobbin or cheese winding machines the particular yarn eyelet that defines the apex of the jigging triangle is located precisely at a right angle below the crossing point of the reverse thread undercuts of the winding drum. If the yarn coming from one side, now reaches this crossing point upon jigging, then it is more or less a matter of chance whether from the crossing point on its jigs back in the same direction it came from or runs onward in the other direction. Since this insidious winding fault usually only occurs sporadically, it has generally not even been discovered heretofore. However, the proposed center-to-center offset of 10 mm eliminates this winding fault with great reliability. The yarn eyelet is not located perpendicularly below a crossing point of the reverse thread undercuts and therefore the yarn is always delivered obliquely to the crossing point. As a result, the yarn is forced to follow the further course of the particular reverse thread undercut in which it is located at that time, rather than to change reverse thread undercuts at the crossing point. The proposed center-to-center offset is dependent on the winding direction, as will be explained in further detail in the description of the exemplary embodiment of the invention given below.

Since the invention provides an unusually large jigging triangle, the advantages thereof at an elevated winding speed could be lost again as a result of yarn vibrations. In order to prevent this, it is provided according to a further development of the invention that at least one vibration damping surface is provided that is in contact with the yarn in the plane of the yarn jigging triangle forming between the yarn eyelet and the winding drum during winding. During the vibration of the yarn, the most dangerous yarn movements are those directed up and down. It is therefore advantageous for the vibration damping surface to be disposed on both sides of a fork through which the yarn or thread runs in a jigging manner. The yarn can be threaded very easily into the fork from the side. The fork width then limits the amplitude of the yarn vibration.

The drive unit of the cross-wound bobbin or cheese winding mechanism has been listed as one of the standard units. To attain this is a consistent manner, it is advantageous for the drive unit to have its own drive motor, which protrudes from the housing of the drive unit. Switchable gear components are also part of the drive unit as a whole. The advantage of this separate drive is also in particular that different winding speeds can be established from one winding device to another, because regulation or control of rotational speed is advantageously provided at the drive motor or at the drive unit.

The drive unit advantageously has one gear each for driving the winding drum, the upper and lower pivot nozzles, and the aforementioned common gear of the yarn tensioner and yarn waxing unit. The two pivot nozzles are advantageously equipped with suction control devices and with devices for cutting off leftover yarn. If these devices are present, then they too are connected to the gear of the pivot nozzles. This is done, for example, in a known manner by means of sets of cams, which control the various shutoff devices or separating devices through feeler levers.

The individual gears may in turn have indexing couplings, which would, for instance, be necessary in the case of the gear for driving the pivot nozzles.

According to a further development of the invention, the blower unit is united with the cross-wound bobbin or cheese changer to form a common structural assembly. This considerably lowers the engineering expense.

Other features which are considered as characteristic for the invention are set forth in the appended claims.

Although the invention is illustrated and described herein as embodied in an automatic cross-wound bobbin or cheese winding machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
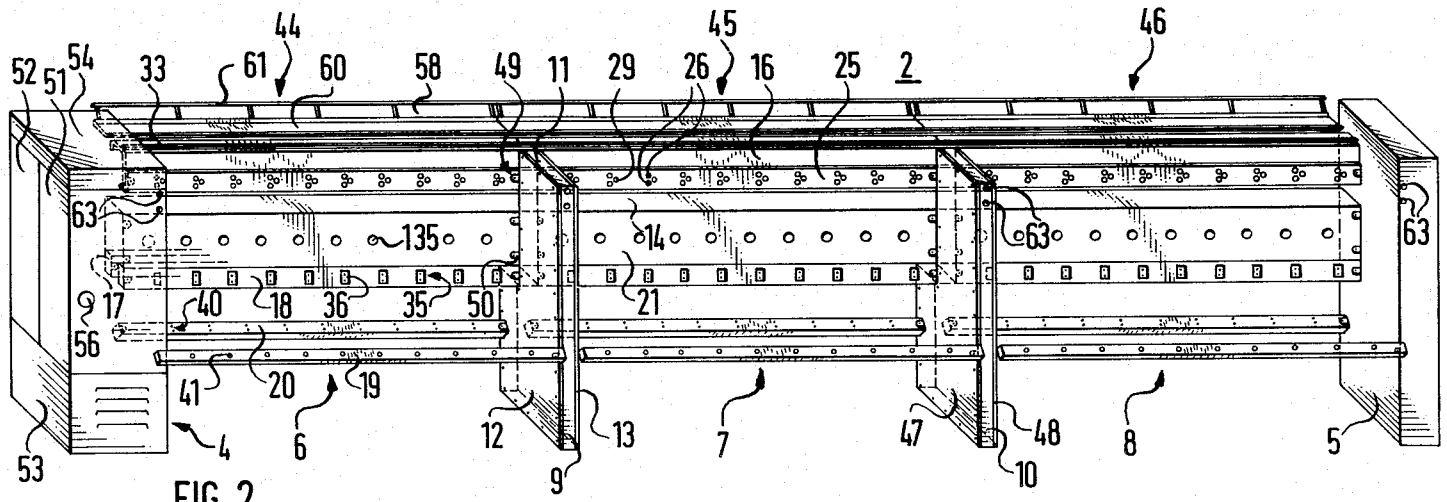
FIG. 2 is a perspective view of a frame assembly.
Figure 2A:
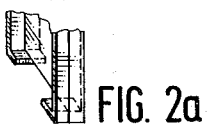
Figure 3:
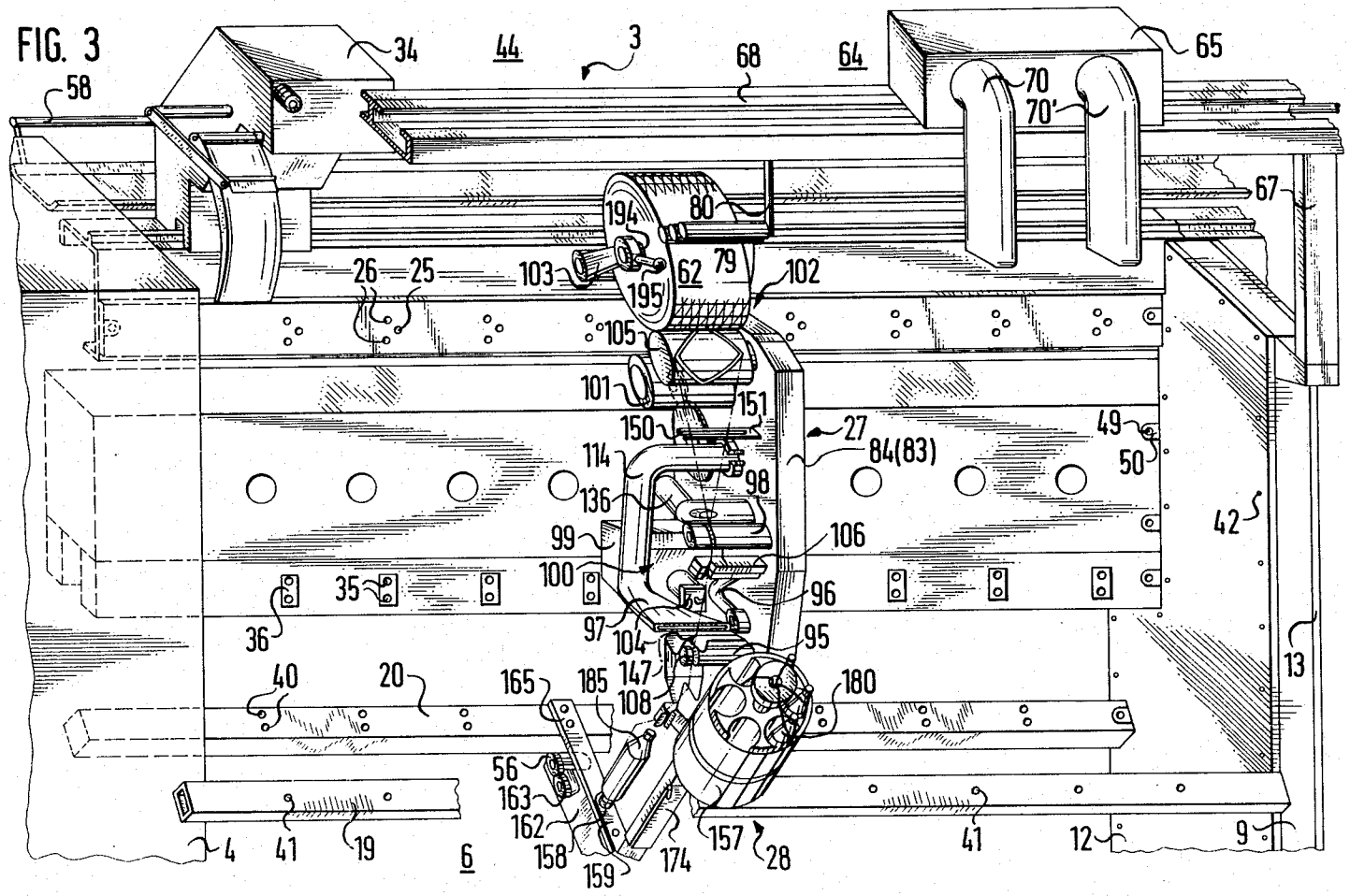
Figure 4:
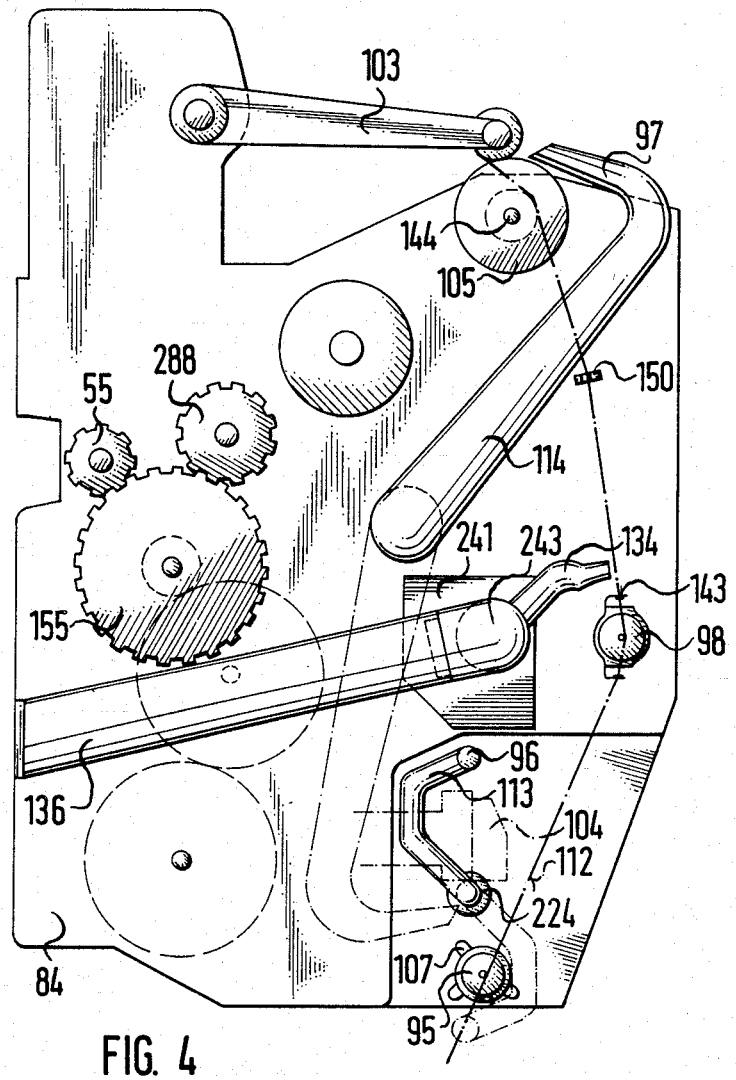
Figure 6:
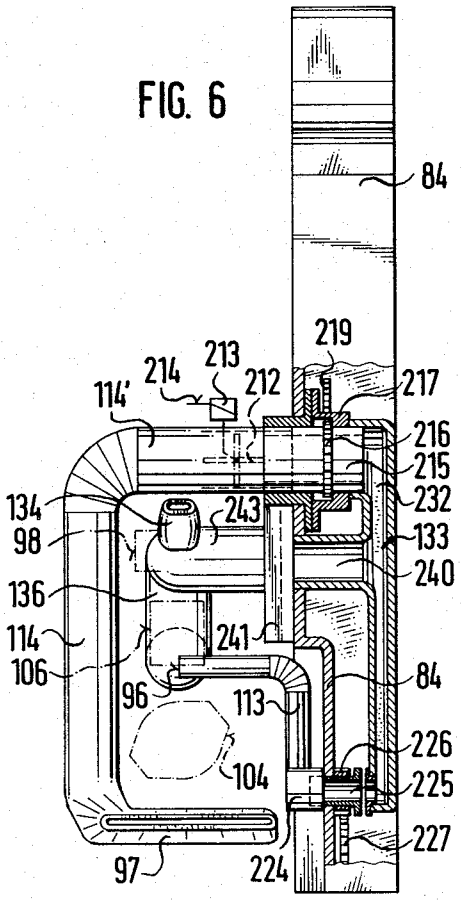
Figure 5:
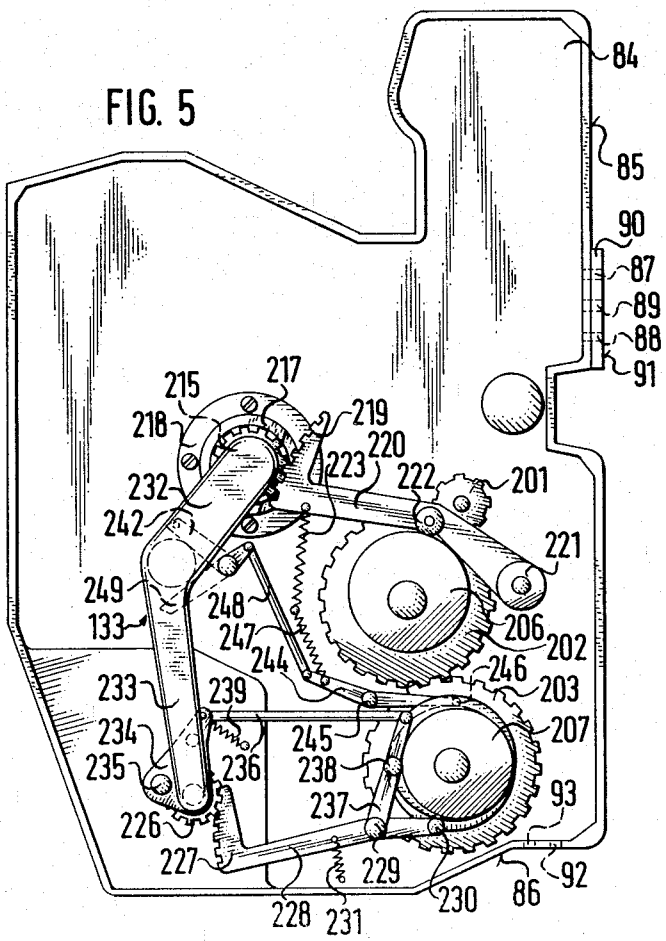
Figure 7:
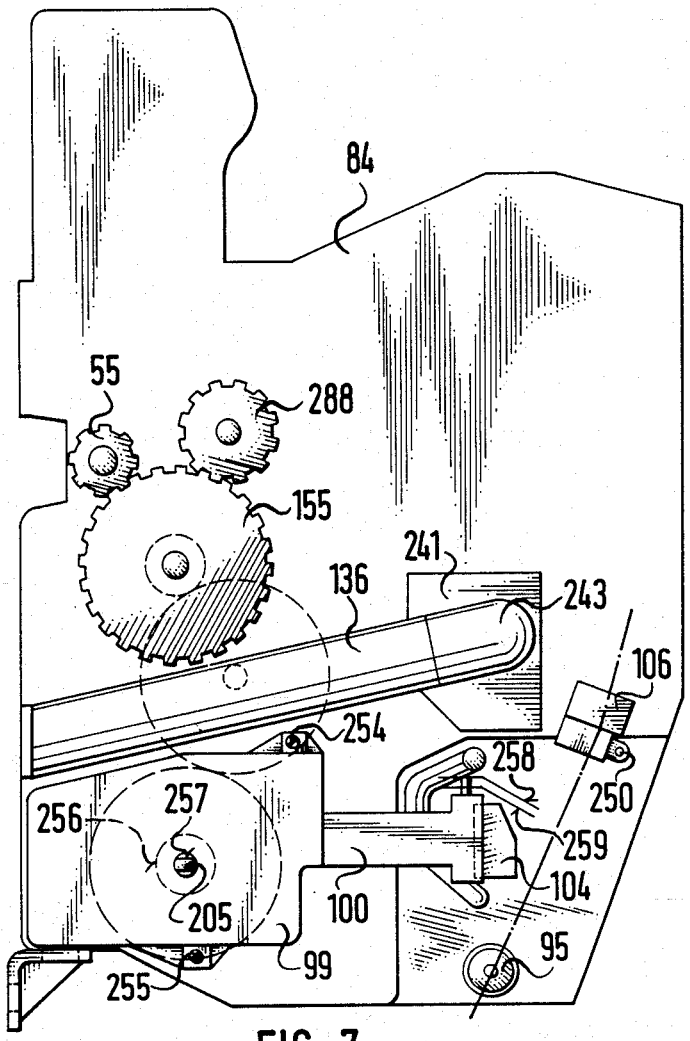
Figure 9:
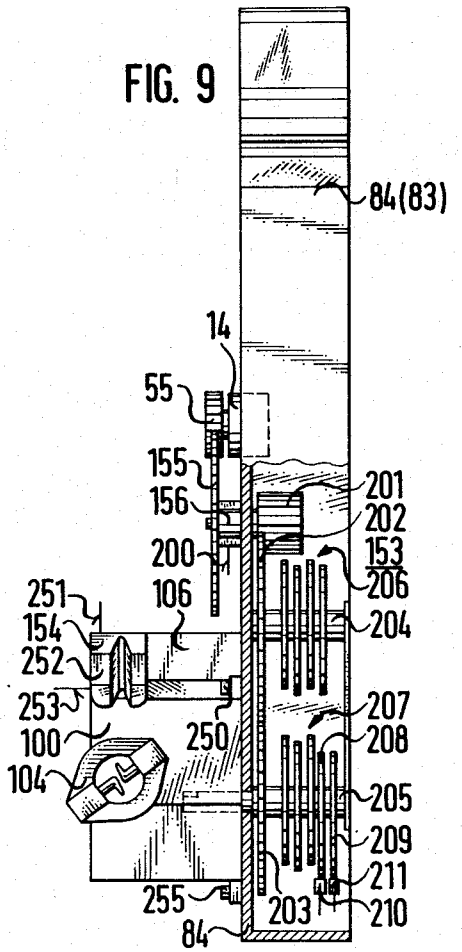
Figure 8:
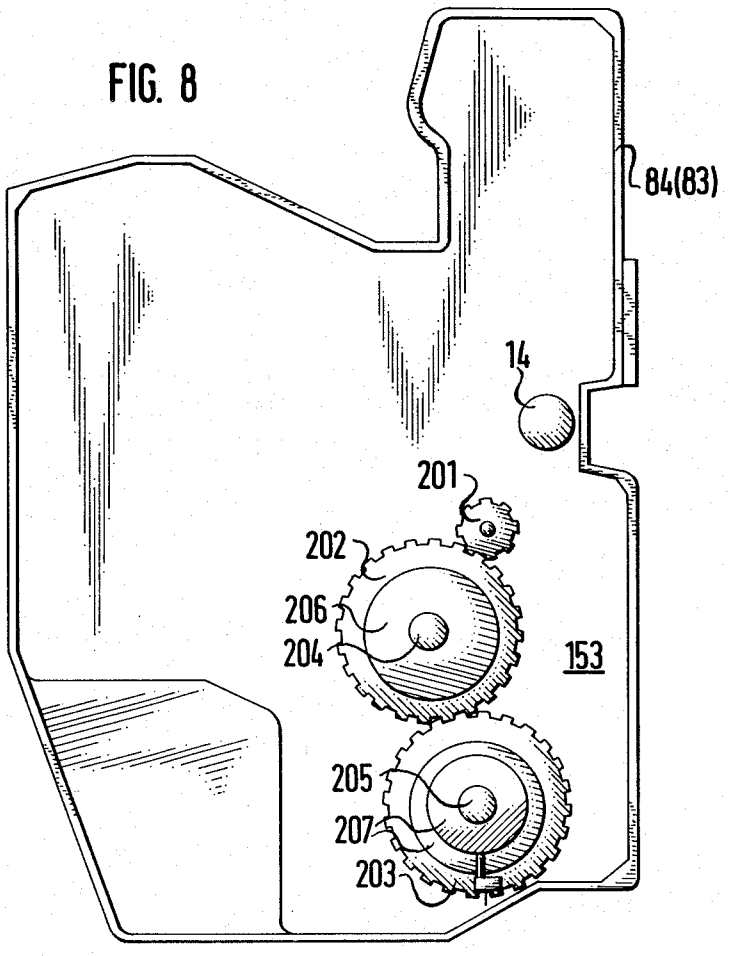
Figure 10:
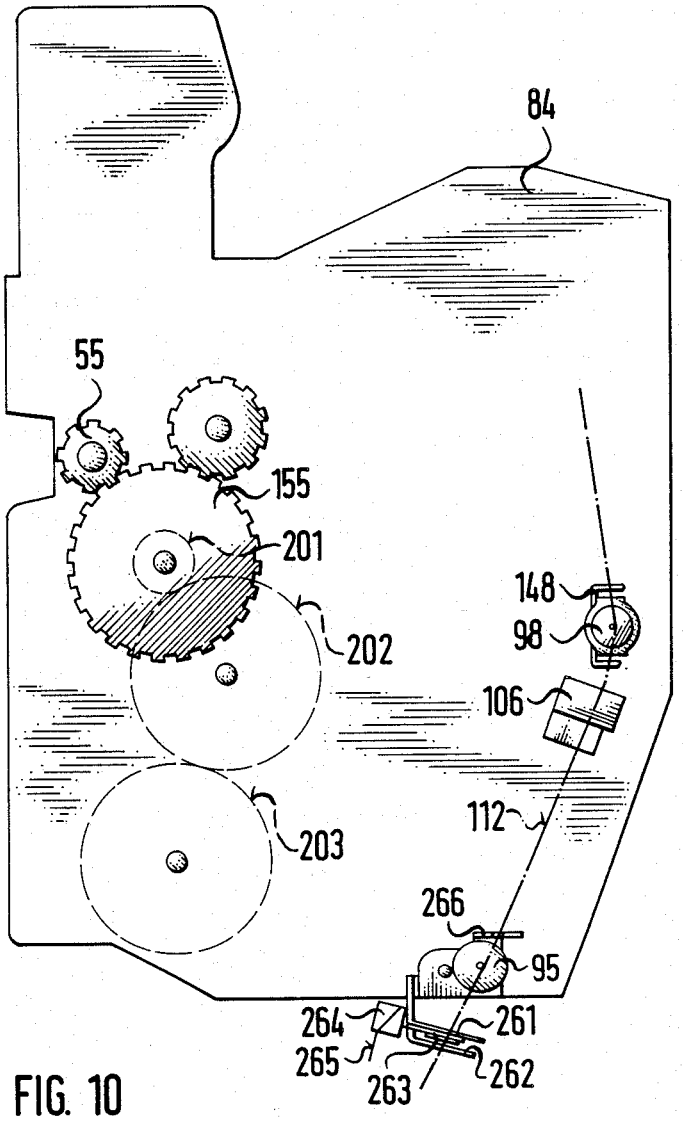
Figure 12:
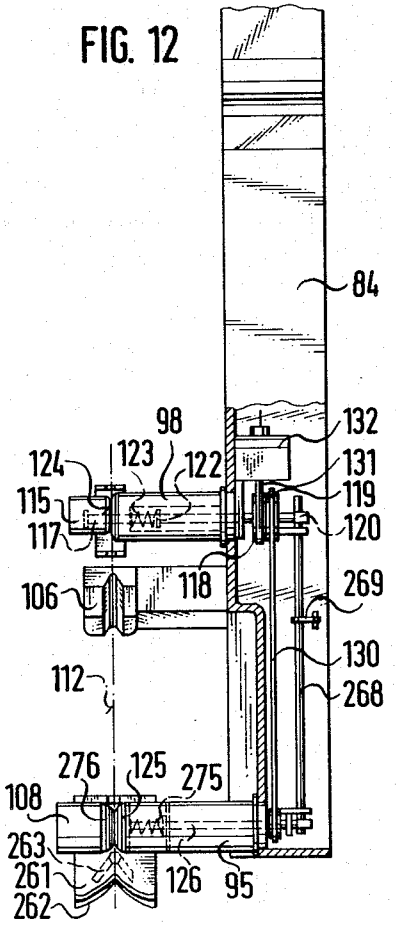
Figure 11:
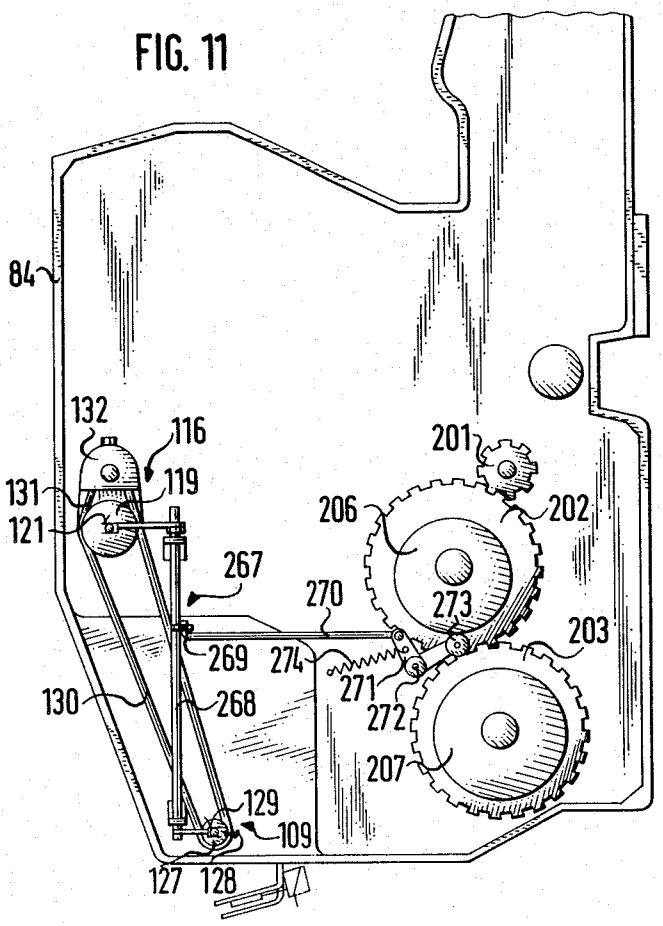
Figure 14:
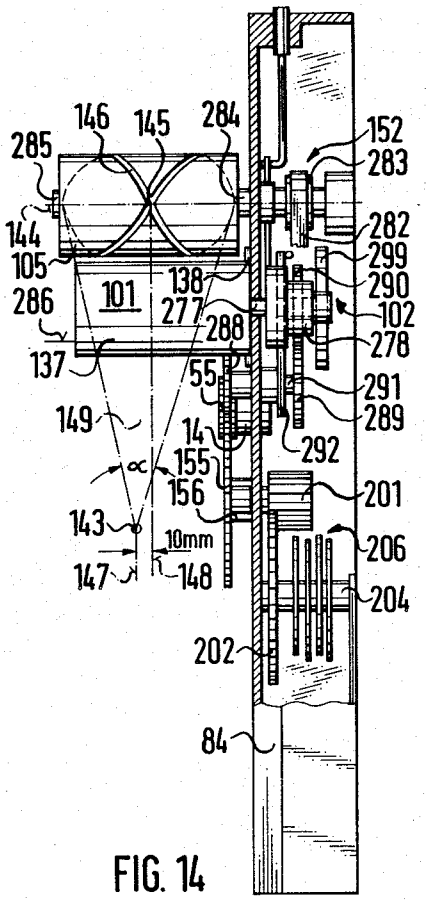
Figure 13:
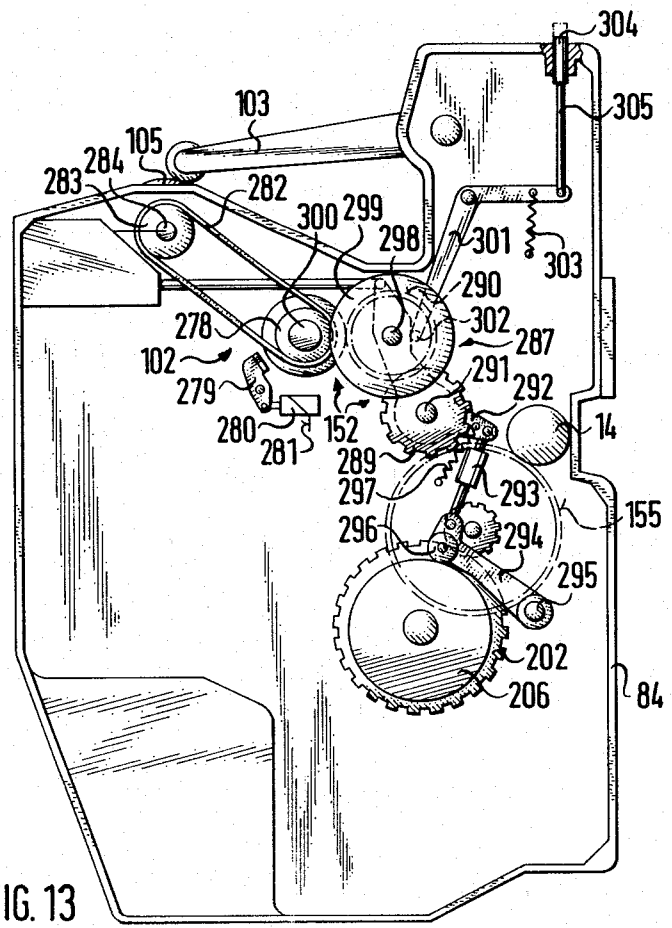

FIG. 2*a* is a fragmentary, perspective view of an alternative embodiment of a portion of the device;

FIG. 3 is a fragmentary, perspective view of the frame assembly of FIG. 2 with a winding device, a blower assembly, and a spool holding assembly attached and with a cross-wound bobbin or cheese changer mounted;

FIG. 4 is a front-elevational view of a yarn take-up assembly with some details relating to the distribution of suction air;

FIG. 5 is an elevational view of the inside of a drive unit with details of gears for suction air distribution;

FIG. 6 is a partially broken-away view of the narrow side of the housing of the drive unit with details of the suction air distribution;

FIG. 7 is an elevational view of the yarn take-up assembly with details of the yarn joining device;

FIG. 8 is an elevational view of the inside of the housing with details of the gearing;

FIG. 9 is a partially broken-away view of the narrow side of the housing with details of the gearing;

FIG. 10 is an elevational view of the housing with details of the yarn tensioner and the yarn waxing unit;

FIG. 11 is an elevational view of the inside of the housing with details of the gearing of the yarn tensioner and the yarn waxing unit;

FIG. 12 is a partially broken-away view of the narrow side of the housing with details of the yarn tensioner and the yarn waxing unit;

FIG. 13 is an elevational view of the inside of the housing with details of the gearing of the cross-wound bobbin or cheese winding mechanism; and FIG. 14 is a partially broken-away view of the narrow side of the housing with details of the gearing of the cross-wound bobbin or cheese winding mechanism.

Figure 1:
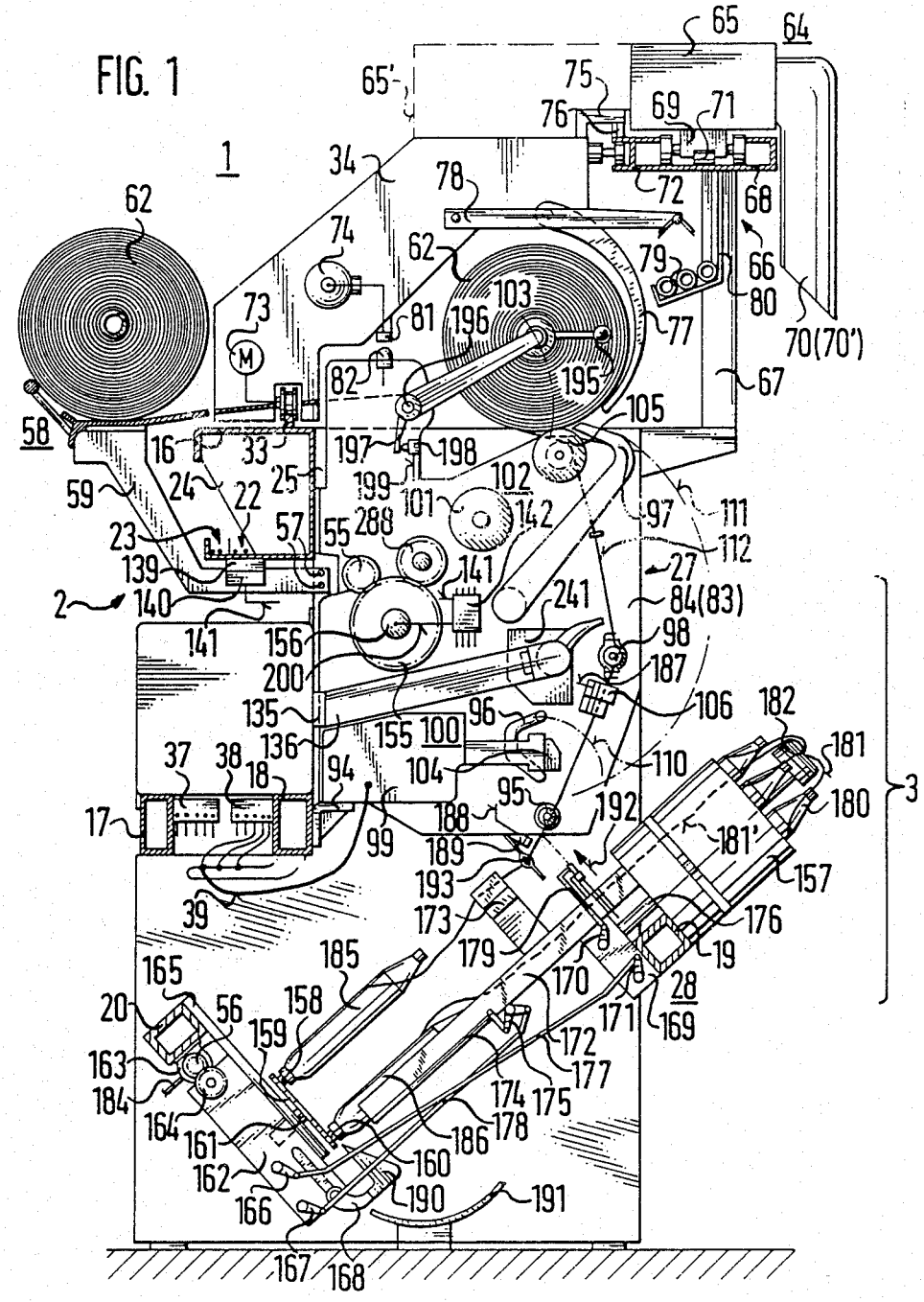
FIG. 1 is a diagrammatic, sectional view of a frame assembly and a front-elevational view of a winding device.

Referring now to the figures of the drawings in detail and first, particularly, to FIG. 1 thereof, there is seen an automatic cross-wound bobbin or cheese winding machine identified as a whole by reference numeral 1. The winding machine is formed of a support frame 2 and a plurality of winding devices 3 secured to the support frame 2. The drawings only show a single one of the winding devices.

The automatic cross-wound bobbin or cheese winding machine 1 is assembled according to the modular principle from pre-assembled structural units. The structural units are each formed of individual parts which are as identical as possible in terms of the type of parts used. A plurality of units are combined to make model-specific, pre-assembled structural assemblies. Each unit and each assembly has pre-readied fastening means, position-fixing means and/or couplings for energy supply means. The fastening means and position-fixing means are intended for interchangeable positionally accurate clamping to an adjoining structural unit or assembly. Details of these fundamental points will become apparent from the ensuing discussion.

As FIG. 2 shows in particular, the support frame units, which will be discussed in greater detail below, form a model-specific, pre-assembled frame assembly 2. The number of units of this frame assembly depends on the number of winding devices. In the present illustrated embodiment, a total of thirty winding devices are provided.

The frame assembly 2 has a front end frame 4 and a rear end frame 5. The front end frame is joined by means of a frame kit generally identified by reference numeral 6, in such a way that an intermediate frame 9 is formed with another frame kit 7. The frame kit 7 is joined in such a way that an intermediate frame 10 is formed with a further frame kit 8. The frame kit 8 is joined to the rear end frame 5.

The intermediate frame 9 is formed of side walls 12, 13 of the frame kits in the form of sheet-steel plates, which are spaced apart from one another by spacer elements 11 and are detachably screwed together in a spaced-apart manner. The intermediate frame 10 is constructed like the intermediate frame 9. FIG. 2 shows that a plurality of screw connections is present, especially at the edge of the sheet-steel plates. The spacer elements 11 are likewise preferably disposed in the vicinity of the edge of the sheet-steel plates. An alternative embodiment of the side walls is shown in FIG. 2*a*. In FIG. 2*a*, the plates rest on one another and are provided with edges projecting beyond the plates for stability.

Using the frame kit 6 as an example, it is demonstrated in FIG. 2 that a frame kit has an upper traverse 16 formed of sheet steel, two parallel middle traverses 17 and 18, a front traverse 19, a rear traverse 20, a suction conduit section 21 and one or two separate side walls 12, 13 as the situation may be.

As shown particularly in FIG. 1, the upper traverse 16 has a box-like profile, which is opened at the back or bottom and thereby enables cables 22 or lines 23, for instance, to be layed in and retained. Reinforcement plates 24 are welded in the interior of the upper traverse 16 at regular intervals. The front long side of the traverse 16 has a continuous, flat-machined reinforcement strip 25. The reinforcement strip 25 has pairs of threaded bores 26 formed therein for fastening a yarn take-up assembly 27 of the winding devices 3. Each winding device has one such yarn take-up assembly 27 and one yarn feed assembly 28 as seen in FIG. 3. One alignment pin bore 29 is formed next to each pair of threaded bores 26 for the positional fixation of the yarn take-up assemblies 27.

A guide rail 33 is also secured to the upper traverse 16. The rail 33 serves as guide means on which a movable automatic cross-wound bobbin or cheese changer 34 shown in FIG. 1 may travel. At the same time, however, the traveling rail 33 also stabilizes the upper traverse 16.

The middle traverses 17 and 18 are mutually parallel and alongside one another and are in the form of square tubes, as shown particularly in FIG. 1. Both middle traverses can carry compressed air. Alternatively, the compressed air can be carried by separate hose or pipeline sections that can be coupled to one another and can have approximately the same length as a traverse. The front middle traverse 18 at the same time serves to hold the yarn take-up assemblies 27. To this end, the middle traverse 18 has pre-readied fastening means 35, in the form of threaded bores that are machined into ribs 36. The ribs 36 are welded onto the middle traverse 18 at regular intervals.

FIG. 1 shows that the middle traverse 17 has a compressed air distributor device 37 and the middle traverse 18 has a compressed air distributor device 38. Both compressed air distributor devices are tubular in form and are disposed approximately at the middle of the length of the traverse. Dashes and dots in FIG. 1 indicate that each compressed air distributor device 37, 38 has ten outlets. A coupling device 39 in the form of a compressed air hose is connected at each of the outlets of the compressed air distributor device 38. The compressed air hoses lead to devices that will be described in detail below. The same is true for the outlets of the compressed air distributor device 37.

The two traverses 19 and 20 also have pre-readied fastening and position-fixing means in the form of threaded bores 40, 41, which serve to fasten and positionally secure the yarn feed assemblies 28.

FIG. 2 does show the completely pre-assembled support frame or completely pre-assembled frame assembly 2, but it must be pointed out at this time that the frame assembly 2 is already formed of three structural assemblies 44, 45 and 46, which are separately pre-assembled and separately movable. The assembly 44 is formed of the front end frame 4 and the frame kit 6 with one half, namely the sheet-steel plate 12, of the separable intermediate frame 9. The assembly 46 is formed of the rear end frame 5 and the frame kit 8 with one half, namely a sheet-steel plate 48, of the separable intermediate frame 10. The assembly 45 is formed of the frame kit 7, which contains the two remaining intermediate frame halves, namely the sheet-steel plate 13 of the intermediate frame 9 and a sheet-steel plate 47 of the intermediate frame 10.

In this manner, the frame assembly 2 is first broken down into three more easily handled assemblies. By inserting additional assemblies 45, the frame assembly 2 can be lengthened as desired. In order to join the assemblies together, the sheet-steel plates of the intermediate frame are simply screwed together, along with the spacer elements. The sheet-steel plates 12, 13, 47, 48 have fastening means in the form of through bores 42 for screws shown in FIG. 3, while the spacers may either have through bores as well or threaded bores. The great number of screw connections assures exact attachment; under some circumstances, separate position-fixing means may not even be necessary, but they may be present in the form of alignment pin/alignment bore combinations.

The individual traverses of the particular frame kit also have fastening and position-fixing means for joining them with the end frames or side walls. These means typically are formed of threaded bores 49 located in the traverses and straps 50 each provided with a hole and located on the side walls.

FIG. 2 indicates that the frame assembly 2 in the front end frame 4 includes a central control device 51, a compressed air supply device 52, a suction supply device 53 and a switching and supply device 54 for electrical energy. Further details of these devices are not provided in FIG. 2. In this illustrated embodiment, the suction supply device 53 is intended to include an exhauster with a dust removal filter; the central control device 51 includes an adjuster for the yarn joining or splicing time of a yarn joining device 100; the compressed air supply device 52 includes adjustable pressure reduction valves with means for providing connections to a stationary compressed air network; and the switching and supply device 54 for electrical energy includes the usual fuses, switching devices, distributor devices and indicator devices.

FIG. 1 shows that the frame assembly 2 has pre-readied fastening means and position-fixing means in the form of threaded bores 57 for holding spool holding assemblies 58. Each spool holding assembly includes at least one holder 59, which has a trough 60 seen in FIG. 2. The trough 60 in turn has a guard rail 61. The trough 60 serves as a holding device for completely wound cross-wound bobbins or cheeses 62. The pre-readied fastening means and position-fixing means 57 are disposed on the front end frame 4, on the rear end frame 5 and on the intermediate frames 9 and 10, in the location and disposition indicated in FIG. 1.

The frame assembly 2 also has pre-readied fastening and position-fixing means in the form of further threaded bores 63 shown in FIG. 2, for holding a blower assembly 64 which is indicated in FIG. 1. The pre-readied fastening and position-fixing means 63 are also disposed on the front end frame 4, on the rear end frame 5 and on the intermediate frames 9 and 10, as FIG. 2 shows. The blower assembly 64 is formed of a movable blower unit 65 and supporting units 66. Each supporting unit 66 in turn is formed of a vertical support element 67 and a horizontal beam 68. The blower unit 65 contains an electric blower, an electrically driven carriage 69 and two blower nozzles 70, 70' discharging overhead and aimed at the winding devices 3. The blower unit 65 is supplied with electrical energy from the switching and supply device 54 through an energy supply chain 71. The blower unit 65 has the sole task of shuttling back and forth on the horizontal beam 68 along the machine and thereby aiming a blown air curtain at the front of the machine.

The horizontal beam 68 of the supporting unit 66 of the blower assembly 64 is joined to a guide rail 72. The guide rail 72 serves as guide means for the aforementioned movable automatic cross-wound bobbin or cheese changer 34. The cross-wound bobbin or cheese changer 34 has a carriage motor 73 and an operating motor 74. The bobbin changer 34 is supplied with current through a current pickup 75 from current rails 76, which are connected to the switching and supply device 54. FIG. 1 shows a pivotable spool ejector 77 and a pivotable tube inserter 78 at operating means of the cross-wound bobbin or cheese changer 34 visible on the outside. A small tube magazine 79 is provided at each spool location. In each case the tube magazine 79 is held by a rod 80 secured to the beam 68, as FIGS. 1 and 3 show.

The cross-wound bobbin or cheese changer 34 moves back and forth in operational readiness along the machine and in so doing it senses the indicator status of command transducers 82 which are located on each yarn take-up assembly 27, with an electronic feeler 81. As soon as the cross-wound bobbin or cheese changer 34 receives the operating command from a command transducer 82, the cross-wound bobbin or cheese changer ejects the completely wound cross-wound bobbin or cheese 62 and replaces it with an empty spool tube taken from the tube magazine 79. FIG. 1 indicates that the blower unit 65 can be combined with the cross-wound bobbin or cheese changer 34 into a common separate structural assembly, by joining the parts with traverses 65' represented by dot-dash lines. This assembly would require only one additional carriage motor.

FIGS. 1 and 3 already show that the yarn take-up assemblies 27 include one pre-assembled drive unit 83 and further device units detachably secured to the wide side of the drive unit. The drawings also show that the drive unit 83 has a flat housing 84. The meaning of the term "flat housing" is shown clearly by FIG. 3. In comparison with its length and its width, the housing 84 is notably flat or narrow. This flat structure of the housing contributes to limiting the total length of the cross-wound bobbin or cheese winding machine. The shape of the housing 84 is shown, for example, in FIGS. 5 and 6. There it is also shown that pre-readied fastening means and position-fixing means are located on the narrow sides 85 and 86 of the housing. The narrow side 85 has three bores, including bores 87 and 88 which allow the device to be screwed together with the traverse 16. A bore 89 is calibrated and serves for holding an alignment pin. For the sake of interchangeable positionally accurate clamping of the housing 84 with the upper traverse 16, the narrow side 85 has a reinforcement 90, the surface 91 of which is ground completely smooth. Bores 92 and 93 located in the narrow side 86 serve as fastening means for fastening the housing 84 to the middle traverse 18. On the left-hand wide side, the housing 84 has various fastening and position-fixing means for holding the device units. Those of the fastening and position-fixing means which are shown in the drawings, will be described in further detail below.

The housing 84 is fastened to the frame assembly 2 as follows: Two screws inserted through the bores 87 and 88 are screwed by hand into the threaded bores 26 of the upper traverse 16. Then an angle element 94 seen in FIG. 1 is joined by screws with both the housing 84 and the middle traverse 18. However, the screws are not yet tightened completely. An alignment pin is then hammered in through the calibrated bore 89 and into the alignment pin bore 29 of the upper traverse 16. Only then are the screws tightened fully. If the housing 84 is to be replaced later in the course of a refitting, then the angle element 94 remains fastened to the middle traverse 18. There it can be secured in its position even at the time of the initial assembly by means of an alignment pin or in some other manner.

The aforementioned device units in the illustrated embodiment are again subdivided into standard units, which are identical for all models of the cross-wound bobbin or cheese winding machine and model-specific device units variously constructed depending on the model. The following standard units are, for example, visible in FIGS. 1 and 3: a yarn tensioner unit 95, a lower pivot nozzle 96, an upper pivot nozzle 97, a yarn waxing unit 98, a drive unit 99 of a yarn joining device 100, a drive unit 101 of the cross-wound bobbin or cheese winding mechanism 102 and a pivotable spool frame 103 for the cross-wound bobbin or cheese 62, the spool frame likewise belonging to cross-wound bobbin or cheese winding mechanism 102. Among the model-specific device units in the illustrated embodiment are a knotting unit 104 of the yarn joining device 100, a winding drum 105 of the cross-wound bobbin or cheese winding mechanism 102 and a yarn cleaner 106.

The yarn tensioner unit 95 is detachably mounted on on the lower housing portion of the drive unit 83, below the yarn joining device 100. To this end, the yarn tensioner unit has fastening straps 107 seen in FIG. 4, which are suitable for a screw connection. The yarn tensioner unit 95 includes a yarn disk brake 108 seen in FIG. 3 with two driven brake disks. The drive of the brake disks is effected by a separate drive device 109 shown in FIGS. 11 and 12, which will be described in further detail below.

The pivot path 110 of the lower pivot nozzle 96 as shown in FIG. 1, extends from the travel path of the yarn or thread 112 below the yarn tensioner unit 95 as far as a point above the knotting unit 104. FIG. 6 shows that the pivot plane of the pivot arm 113 of the pivot nozzle 96 in this operation is located between the housing 84 and the knotting unit 104.

The yarn waxing unit 98 is also detachably mounted on the housing 84, above the yarn joining device 100. The yarn waxing unit 98 has a drive device 116 for a roll of paraffin 115 shown. FIGS. 11 and 12 show that the drive device 116 has a shaft 117 on which two cord reels 118 and 119 are secured. The shaft 117 carries the paraffin roll 115 on one end, while its other end is provided with a groove 120 engaged on the inside by a fork 121. The shaft 117 is also provided with a spring washer 122, against which a spring 123 is braced. The paraffin roll 115 is pressed with slight pressure against a yarn rest 124 under the influence of the spring. As shown in these same figures, the drive device 109 of the disk yarn brake 108 includes a shaft 126 joined to a disk 125 and a cord reel 127 being secured on the shaft 126. The other end of the shaft 126 has a groove 128, the inside of which is engaged by a fork 129. A connection is established between the drive devices 109 and 116 by means of a traction element 130 in the form of a round cord, which is wrapped around the cord reels 119 and 127. The cord reel 118 is connected to a common drive motor 132 by means of further traction means 131 in the form of a round cord.

The yarn cleaner 106 is disposed in the yarn path between the yarn tensioner 95 and the yarn waxing unit 98 above the yarn joining device 100.

The pivot path 111 of the upper pivot nozzle 97 extends from a position located near the cross-wound bobbin or cheese 62 as far as a point below the knotting unit 104. FIGS. 5 and 6 show that the pivot arm 114 of the upper pivot nozzle 97 is pivotable in a pivot plane located in front of the outer ends of the yarn waxing unit 98, the knotting unit 104 and of the yarn cleaner 106.

FIG. 6 shows that the housing 84 has a suction air distributor 133, to which the two pivot nozzles 96, 97 and a yarn catching nozzle 134 disposed above the yarn waxing unit 98, are connected.

A suction conduit 21 shown in FIG. 1 has one connection element 135 for each winding device 3. The connection elements are in the form of pipe connectors. The suction air distributor 133 of the drive unit 83 is connected to one of the connection elements 135 at a time by means of a coupling tube 136. The drive unit 101 of the cross-wound bobbin or cheese winding mechanism 102, as shown in FIGS. 13 and 14, has its own drive motor 137, which is detachably mounted on the housing 84 of the drive unit 83. Two fastening feet 138 seen in FIG. 13 are used for this purpose.

FIG. 1 shows that the frame assembly 2 has at least one multi-contact outlet 139 for each winding device 3 for supplying the drive motors with electrical energy. The individual drive units 83 of the winding devices 3 have at least one multi-contact plug 140 for the same purpose. As shown in FIG. 1, the multi-contact plug 140 is connected by a cable 141 with a switching and distributor device 142. Electrical or pneumatic control lines, blown air lines or the like can also be constructed as plug-connectors and can have plugs.

FIG. 4 in particular shows that a yarn eyelet 143 is disposed above the yarn waxing unit 98. The yarn eyelet is located 25 to 35 cm away from the central axis 144 of the winding drum 105. FIG. 14 shows that the yarn eyelet 143 has a center-to-center offset of 10 mm with respect to the winding drum 105. Located in the middle of the winding drum 105 is a crossing point 145 of a reverse thread undercut 146, which guides the yarn or thread 147 as it is wound onto the spool. The central vertical line 148 located in the plane of the drawing and passing through the crossing point 145 has the aforementioned offset of 10 mm with respect to the yarn eyelet 143 and hence with respect to the yarn 147 traveling to the eyelet.

The distance by which the eyelet 143 is spaced apart from the central axis 144 of the winding drum 105 has been set as 25–35 cm. This range of length depends on the shortest and longest length permitted for the winding drum to be exchanged. Taking this into account, the yarn eyelet 143 is located far enough from the winding drum 105 that a yarn jigging or traversing triangle 149 that forms between the yarn eyelet 143 and the winding drum 105 during the winding has an angle of a maximum of 45°. FIGS. 3 and 4 show that at least one vibration damping surface 150 that is in contact with the triangle 149 that forms during winding between the yarn eyelet 143 and the winding drum 105. As FIG. 3 shows quite clearly, the vibration damping surface 150 is disposed on both inner surfaces of a fork 151 through which the jigging or oscillating thread or yarn 147 passes.

The drive unit 83 includes a plurality of gears. FIGS. 13 and 14 show a gear generally identified by reference numeral 152, for driving the winding drum. FIGS. 8 and 9 show a gear generally identified by 153, for driving the upper and lower pivot nozzles 97, 96 and the combined yarn separating and clamping device 154 of the yarn cleaner 106. The gear 153 is also used for actuating the yarn joining device 100. The drive unit 83 also includes the drive devices 109 and 116, which are in the form of traction gears and are joined together by traction means 130, for driving the yarn tensioner 95 and the yarn waxing unit 98. FIG. 9 indicates that the gear 153 for driving the upper and lower pivot nozzles 97, 96 and the yarn separating and clamping device 154 of the yarn cleaner 106 has a gear wheel 155, which engages a pinion 55 of a constantly running drive motor 14. Details of the gears will be described below.

FIGS. 1 and 3 show that the yarn feed assembly 28 has a runoff spool or delivery bobbin magazine 157 and a yarn run-off or unwinding location 158. The yarn run-off location 158 includes a mandrel which is disposed on a reversing or turnover plate 159. A further mandrel 160 is located on the other end of the turnover plate 159. A pivot shaft 161 of the turnover plate 159 can be rotated about an angle of 180° with the aid of a gear 162. The gear 162 has a gear wheel 164, which is in engagement with pinion 56 of a drive motor 163. The gear 162, which at the same time forms a sturdy supporting body, is screwed to the rear traverse 20 by means of a strap 165. FIG. 1 shows that the gear 162 also has three pivot levers 166, 167, 168.

The run-off spool magazine 157 is screwed to the front traverse 19. A gear 169, which is likewise screwed to the front traverse 19, is also part of the run-off spool magazine 157. The gear 169 has two pivot levers 170, 171. It also has a slide 172, which has a yarn balloon breaker 173. The lower end of the slide 172 has a flap 174, which can be opened and closed with the aid of a bell crank 175. The gear 169 is joined to the run-off spool magazine 157 by means of a shaft 176. The pivot lever 171 is seated on the drive side of the gear 169 and is connected with the pivot lever 166 of the gear 162 by an indexing rod 177. The bell crank 175 is connected by an indexing rod 178 with the pivot lever 167 of the same gear 162. The pivot lever 170 is connected to a yarn guide rod 179. The run-off spool magazine 157 is filled with run-off spools 180, the yarn ends 181 of which are held firmly by a yarn holder 182. The drive motor 163 is connected by a plug connection 184 with the switching and distributor device 142. The switching and distributor device 142 in this case is the central switching location of the individual winding device 3. The switching location is in turn connected with the central control device 51 and with the switching and supply device 54.

A run-off spool 185 is located in the run-off position at the yarn run-off location 158. As soon as a yarn monitor 189, which is connected by a line 188 with the switching and distributor device 142, triggers the command for a change of run-off spools, the drive motor 163 is switched on, until such time as the following activities have taken place:

The absence of the yarn or thread 112 ascertained by the yarn monitor 189 leads to the conclusion that a run-off spool 185 has run empty, or in other words that only left-over windings are on the spool or the spool tube is empty. As a first activity, the shaft 161 therefore causes the pivoting of the turnover plate 159 about an angle of 180°, by means of which the run-off spool 186 that is in reserve moves into the yarn run-off position. The empty spool tube of the other spool is simultaneously moved into the reserve position, whereupon the gear 162 actuates the pivot lever 168, with the consequence that a tube ejector wedge 190 slides beneath the spool tube and thus disengages the spool tube from the holder mandrel. At the same time, the pivot lever 167 is actuated, with the consequence that the flap 174 opens, so that the empty spool tube drops into a trough 191 located on the floor. The trough 191 can also be replaced by a conveyor belt, which moves the empty tubes of the entire machine to one end of the machine. Next, the flap 174 is closed again and then the gear 162 actuates the pivot lever 166, with the consequence that the gear 169 comes into play. First, the gear 169 pivots the pivot lever 170, with the consequence that the yarn end of the spool located in the run-off position is moved in the direction of an arrow 192 as far as the pivot path 110 of the lower pivot nozzle 96. At the same time, the yarn end is threaded into a yarn eyelet 193 and into the yarn balloon breaker 173. As soon as this has been done, the gear 169 turns the shaft 176, with the result that one of the run-off spools 180 located in the run-off spool magazine 157 is transferred to the slide 172 and thereby reaches the mandrel 160 or the reserve position. The yarn or thread 181' is still held firmly by the yarn holder 182 at that time. The filling of the run-off spool magazine 157 is carried out manually in this case, but it can also be accomplished automatically.

According to FIGS. 1 and 3, the spool frame 103 that belongs to the standard units has a rotatably supported spool holder mandrel 194, a handle 195 and a pivot shaft 196. The pivot shaft 196 has an indexing prong 197 which acts upon a microswitch 198 as soon as a certain spool fullness has been attained, as shown in FIG. 1. The microswitch 198 is connected to the switching and distributor device 142 by a line 199.

Details of the gear 153 are shown in particular in FIG. 9. The gear wheel 155 continuously meshes with the pinion 55 of the drive motor 14. The indexing coupling 156 connected to the gear wheel 155 has a direct line connection 200 with the switching and distributor device 142. A gear wheel 201 is provided on the power takeoff side of the indexing coupling 156. The gear wheel 201 meshes with a gear wheel 202, which in turn drives a gear wheel 203. A cam disk set or package 26 is seated on the shaft 204 of the gear wheel 202. A cam disk set or package 207 is seated on the shaft 205 of the gear wheel 203. The cam disks are shown diagrammatically. In practice, they may have different diameters and contouring of the periphery thereof to suit their purpose. FIG. 9 shows that the shaft 205 protrudes far as into the housing of the yarn joining device 100 where it is connected with non-illustrated gear parts which serve to drive the yarn joining device 100 or its knotting unit 104. Cam disks 208 and 209 of the cam disk set 207 serve merely as switching disks for switching microswitches 210, 211.

The courses of motion of the standard units 96, 97 will now be explained, while referring to FIGS. 4–6.

The lower pivot nozzle 96 and upper pivot nozzle 97 are located in the basic position as shown in FIG. 6. As a preassembled unit, the upper pivot nozzle 97 includes the actual nozzle itself with the pivot arm 114 and a switchable throttle valve 212, which is drivable by means of an electromagnet drive 213. The electromagnet drive 213 is connected with the switching and distributor device 142 by a plug contact 214. A horizontal section 114' of the pivot arm 114 is mounted in such a way that it locks into position on a rotatably supported tube 215, which has outer teeth 216. A bearing 217 of the tube 215 has a flange 218, which is detachably fastened from inside on the housing 84. The outer teeth 216 engage a toothed quadrant 219, which is disposed at the end of a lever 220. The lever 220 is supported with a hinge 221 on the housing 84. The lever has a feeler roller 222 which rests on a cam disk of the cam disk set 206 under the influence of a tension spring 223. The upper pivot nozzle 97 can be moved from the basic position shown in dot-dash lines in FIG. 4, into the suction position shown in solid lines, and back again, by rotating the cam disk.

The lower pivot nozzle 96 is a standard unit which includes the actual nozzle and the pivot arm 113 and foot 224. The foot 224 is seated lockingly upon a rotatably supported tube 225, which has outer teeth 226. Engaging the outer teeth 226 is a toothed quadrant 227, which is seated at the end of a two-armed lever 228. With its hinge 229, the lever 228 is supported from the inside on the housing 84. The shorter end of the lever 228 has a feeler roller 230 which rests on a cam disk of the cam disk set 207 under the influence of a tension spring 231. The lower pivot nozzle 96 can be moved out of the position of repose shown in solid lines in FIG. 4 and into the suction position shown in dot-dash lines, and back again, by rotating the cam disk set 207.

The supply of suction to the two pivot nozzles is provided through the suction air distributor 133. One arm 232 of the suction air distributor is connected to the tube 215. The other arm 233 discharges at a location spaced slightly apart from and in front of the tube 225. A locking slide 234 seen in FIG. 5 can pivot between the two parts, its pivot axis 235 being supported on the housing 84. The actuation of the locking slide 234 is effected through a lever linkage 236, 237. The lever linkage is supported on a hinge 229 and has a feeler roller 238, which continuously rests on a cam disk of the cam disk set 207 under the influence of a tension spring 239. Depending on the position of the cam disk, the locking slide 234 either enables the flow of suction air, or prevents it. A middle connector 240 of the suction air distributor 133 is connected through leftover yarn scissors 242 disposed in a housing 241 to a catching nozzle holder 243, which holds the yarn catching nozzle 134. The housing 241 along with the catching nozzle holder 243 are screwed in common onto the housing 84 from outside. The coupling tube 136, which establishes the communication with the suction conduit 21, is connected to the catching nozzle holder 243.

In order to drive the leftover yarn scissors 242, a rocker 244 is provided, which has a pivot shaft 245 that is secured to the housing 84. On one side, the rocker has a feeler roller 246, which constantly rests on a cam disk of the cam disk set 207 under the influence of a tension spring 247. The other end of the rocker 244 is pivotably connected by means of a drawbar 248 with a movable blade 249 of the leftover yarn scissors 242. Normally, the leftover yarn scissors 242 are opened, as shown in FIG. 5. It is only at the instant at which both pivot nozzles are in action and are aspirating yarns, that the leftover yarn scissors 242 are actuated, preferably at an instant at which the suction ceases. The aspirated yarns are given a predetermined length by means of the leftover yarn scissors 242.

FIG. 9 shows that the yarn cleaner 106 is secured in such a way that it is easily removable from the housing 84 with the aid of pre-readied fastening means 250. The combined separating and clamping device 154 of the yarn cleaner 106 is actuated electrically, and to this end it is connected by a line 251 with the switching and distributor device 142. A measuring head 252 is also connected with the switching and distributor device 142 by a line 253.

As shown in FIG. 7, the drive unit 99 of the yarn joining device 100 is secured to the housing 84 by means of two screws 254, 255. To this end, the housing 84 has pre-readied fitting threaded bores. By securing the drive unit 99 to the housing 84, the coupling of a shaft 205 to a gear wheel 256 present in the drive unit 99 takes place automatically. The end of the shaft 205 has a flattened region 257 for this purpose and the gear wheel 256 has a matching recess. The knotting unit 104 is inserted in a lockable manner into the drive unit 99 of the yarn joining device 100. The yarn joining device 100 has yarn guide jacks 258, 259 which serve to guide the yarn during the joining operation.

FIG. 10 shows a somewhat different course of yarn insertion into the yarn tensioner unit 95. Instead of one yarn eyelet, two slit jacks 261, 262 are provided on the yarn entry side, between which a pair of leftover yarn scissors 263 is located. The leftover yarn scissors 263 are actuated by an electromagnet drive 264. The electromagnet drive 264 is connected with the switching and distributor device 142 by a line 265. The purpose of the leftover yarn scissors 263 is to assure that when there is a change of run-off spool, that no yarn connection whatever exists any longer between the old run-off spool, or its spool tube, and the drive unit 83', or the yarn take-up assembly 27. Yarn ends that hang down would hinder a change of spools or would lead to disruptions in the ensuing yarn joining operation. A further slit jack 266 for guiding the yarn 112 is also disposed above the yarn tensioner unit 95.

FIG. 11 shows further details of the drive device 116 for driving the paraffin roll and the drive device 109 for driving the yarn brake. At the time of the insertion of the yarn or of a yarn joining operation, the contact between the paraffin roll 115 and the yarn or thread 112, or between the yarn tensioner 95 and the yarn or thread 112 seen in FIG. 12, must be temporarily interrupted. To this end, a switching device 267 is used. The switching device 267 includes a vertical rod 268 which is rotatably supported on the housing 84 and on which the two forks 121 and 129 are secured. The rod 268 has a lever 269, which is pivotably connected with a bell crank 271 by means of an indexing rod 270. A pivot point 272 of the bell crank 271 is supported in a stationary manner on the housing 84. The other end of the bell crank 271 has a feeler roller 273, which constantly rests on a cam disk of the cam disk set 206 under the influence of a tension spring 274. The rod 268 is pivoted in accordance with the position of the cam disk. FIG. 12 shows the position of repose, in which both the paraffin roll 115 and the disk 125 that is subject to the influence of a compression spring 275 rest on the yarn or thread 112, or on complementary surfaces. If the rod 268 is rotated, the shaft 117 is displaced toward the left as seen in FIG. 12, while the shaft 126 shifts oppositely to the right. The result is the lifting of the paraffin roll 115 from the yarn rest 124 and from the yarn or thread and the lifting of the disk 125 from the complementary or opposing disk 276 and from the yarn or thread.

Details of the cross-wound bobbin or cheese winding mechanism 102 are shown particularly in FIGS. 13 and 14. A shaft 277 of the drive motor 137 has a stepped disk 278 with three graduated diameters. The step having the largest diameter serves as a brake drum. An associated shoe brake is shown at reference numeral 279. The shoe brake 279 can be actuated by a electromagnet drive 280, which is connected by a line 281 to the switching and distributor device 142.

The middle step of the stepped disk 278 has endless traction means 282 wrapped around it, which also run over a belt pulley 283 that is seated on a shaft 284 of the winding drum 105. The winding drum 105 itself is fastened as a separate unit on the shaft 284 in an easily detachable manner. A fastening screw 285 is used for this purpose. The drive motor 137 is connected to the switching and distributor device 142 through a plug connection 286.

When the drive motor 137 is switched on the shoe brake 279 is released and when the motor is shut off the shoe brake is switched on.

In order to find a yarn end that has already run up onto the cross-wound bobbin or cheese, the cross-wound bobbin or cheese must be rotated backward opposite to the winding direction. To this end, first the shoe brake 279 is released and then a reverse-rotation device 287 is activated. Both the reverse-rotation device 287 and the stepped disk 278, including the traction gear 282, are part of the gear for driving the winding drum, which is identified as a whole by reference numeral 152 and has already been mentioned above.

The drive side of the reverse-rotation device 287 has a gear wheel 288 that meshes continuously with the gear wheel 155 and accordingly rotates continuously, as seen in FIG. 7. A further gear wheel 289, which meshes continuously with a gear wheel 290, is seated on a shaft 291 of the gear wheel 288, in the interior of the housing 84. These gear wheels accordingly also rotate continuously. The gear wheel 290 is supported on a swing 292. The swing 292 is pivotable about the shaft 291. The location of the swing 292 is determined by the particular position of a lever 294 through an adjustable length indexing rod 293. The lever 294 has a hinge 295, which is secured to the housing 84.

The lever 294 also has a feeler roller 296, which is continuously in contact with a cam disk of the cam disk set 206, under the influence of a tension spring 297. A friction wheel 299 is secured on the shaft 298 of the gear wheel 290. The friction wheel 299 is formed of a rubber mixture of elevated Shore hardness. Depending on the location of the cam disks, the friction wheel 299 remains out of contact with the smallest step 300 of the stepped disk 278, as shown in FIG. 13, or it rests against that step. The friction wheel 299 is gently pressed against the step 300, with the friction wheel 299 acting as a slip coupling. With the contact made gently, the winding drum 105 is driven backward by the stepped disk 278 for the desired purpose and the rotor of the drive motor 137 rotates idly at the same time.

The particular location of the swing 292 and thus the ON or OFF state of the reverse-rotation device 287 as well, is monitored by a bell crank 301, which has a feeler roller 302 that constantly rests on the swing 292, under the influence of a tension spring 303. A tappet 304 is pivotably connected with the bell crank 301 by a rod 305. The tappet 304 protrudes partly out of the housing 84 at the top. It can be determined whether or not the reverse-rotation device 287 is functioning from the location of the tappet. On the other hand, however, the reverse-rotation device 287 can be put into operation at any time by depressing the tappet 304.

The modular principle utilized in this case offers advantages for both the manufacturer and the user of the cross-wound bobbin or cheese winding machine.

In the case of the manufacturer, for example, the structural assemblies 44, 45, 46 from which any arbitrary supporting frame can be put together, can be prefabricated and kept in inventory. The yarn feed assemblies are also prefabricated, optionally in two or three types, and kept in inventory. The yarn take-up assemblies 27 are always identically constructed, with the exception of the winding drum 105, the yarn cleaner 106 and the knotting unit 104 or splicing unit. They too are prefabricated and kept in inventory. The winding drums 105, the yarn cleaners 106 and the knotting units 104 or splicing units are each prefabricated separately in a plurality of types and are likewise kept in inventory. The blower assembly 64, a plurality of cross-wound bobbin or cheese changers 34 and two types of spool holding assemblies are also prefabricated and kept in inventory. The desired automatic cross-wound bobbin or cheese winding machine is then assembled from these components, depending on what is ordered. As a result of the construction and disposition of the fastening means, position-fixing means and/or couplings for energy supply means according to the invention, the assembly proceeds very quickly, presents no alignment problems and necessarily leads to unproblematic start-up of the machine, without requiring costly adjustment measures. The assembly can be carried out by employees without using a special tool and without particular specialized skills.

For the user of the cross-wound bobbin or cheese winding machine constructed according to the modular principle, there is the advantage of rapid machine refitting, without being forced to hire specialists from the manufacturer's factory. Refitting to other shapes or dimensions of cross-wound bobbins or cheeses to be wound is done simply by changing the winding drums 105. Refitting to another yarn or thread material is done simply by exchanging the yarn cleaner 106 and optionally exchanging the knotting units 104 or the splicing units provided instead of them. The drive unit 99 of the yarn joining device 100 always remains the same. Refitting to other run-off spools does not dictate refitting at the machine, in the normal situation.

However, if the run-off spools have dimensions that deviate substantially from the norm, then the entire yarn feed assembly 28 is simply replaced.

The invention is not restricted to the embodiment shown and described. The automatic cross-wound bobbin or cheese winding machine shown and described can have other structural assemblies associated with it as well. Such further structural assemblies may, for instance, be a run-off spool supply assembly, a tube removal assembly and/or a run-off spool preparation assembly. To this end, the frame assembly, for instance, would have to be provided with the necessary additional fastening and position-fixing means.

I claim:

1. Automatic cross-wound bobbin winding machine, comprising a supporting frame, a plurality of winding devices secured on said supporting frame, each of said winding devices including pre-assembled modular structural units each having individual parts in the form of at least a yarn run-off location for a run-off spool, a yarn tensioner, a yarn joining device, and a cross-wound bobbin winding mechanism, a plurality of said structural units being combined into standardized or model-specific pre-assembled structural assemblies, each of said structural units and each of said structural assemblies having at least one of pre-readied fastening means, position-fixing means and couplings for energy supply means for interchangeable clamping to an adjacent structural unit or structural assembly in an accurate position, each of said winding devices also including one yarn take-up assembly and one yarn feed assembly, said support frame being in the form of a structural frame assembly having at least one end frame as a first structural unit and at least one frame kit supporting said winding devices as a second structural unit, said yarn take-up assembly having a pre-assembled drive unit with at least one wide and at least one narrow side, and said structural units being detachably secured to one of said at least one wide side of said drive unit, said frame kit having at least one upper traverse, at least one lower traverse and at least one middle traverse, and said drive unit having a flat housing with said at least one wide and said at least one narrow side, said at least one narrow side having pre-readied fastening means and position-fixing means for interchangeable clamping to said upper traverse and to said middle traverse in an accurate position.

2. Automatic cross-wound bobbin winding machine according to claim 1, wherein said individual parts include at least one of a yarn cleaner and a yarn monitor.

3. Automatic cross-wound bobbin winding machine according to claim 1, wherein said individual parts include a run-off spool magazine.

4. Automatic cross-wound bobbin winding machine according to claim 1, including other frame kits adjoining said first-mentioned frame kit, the number of said other frame kits being dependent on the number of said winding devices.

5. Automatic cross-wound bobbin winding machine according to claim 1, wherein said individual parts include a yarn cleaner, and said yarn take-up assembly includes at least said yarn tensioner, said yarn joining device, said yarn cleaner and said cross-wound bobbin winding mechanism as structural units.

6. Automatic cross-wound bobbin winding machine according to claim 1, wherein said yarn feed assembly includes at least said yarn run-off location as a structural unit.

7. Automatic cross-wound bobbin winding machine according to claim 1, wherein said individual parts include a run-off spool magazine, and said yarn feed assembly includes at least said yarn run-off location and said run-off spool magazine as structural units.

8. Automatic cross-wound bobbin winding machine according to claim 1, wherein said frame kit has side walls, and including horizontal, rigid traverses joining said side walls in a stabilizing manner.

9. Automatic cross-wound bobbin winding machine according to claim 8, including a rigid suction conduit section joining said side walls in a stabilizing manner.

10. Automatic cross-wound bobbin winding machine according to claim 9, wherein said suction conduit section is in the form of a rectangular tube having two bent sheet-metal strips with the same original shape and dimensions.

11. Automatic cross-wound bobbin winding machine according to claim 1, wherein said frame assembly has a central control device, at least one compressed air supply device, a suction supply device and at least one switching and supply device for electrical energy, as further structural units.

12. Automatic cross-wound bobbin winding machine according to claim 11, wherein said central control device has an adjuster for the yarn joining or splicing time of said yarn joining device.

13. Automatic cross-wound bobbin winding machine according to claim 1, wherein said frame kit has at least one traverse formed of sheet steel with a box-like profile.

14. Automatic cross-wound bobbin winding machine according to claim 13, wherein said frame includes a continuous, flat-machined reinforcement strip on one longitudinal side thereof.

15. Automatic cross-wound bobbin winding machine according to claim 14, wherein said reinforcement strip has at least one of threaded bores for fastening and alignment pin bores for positional fixation of said yarn take-up assemblies formed therein.

16. Automatic cross-wound bobbin winding machine according to claim 1, wherein said frame kit has at least one traverse for holding said yarn feed assemblies, said traverse having pre-readied fastening and position-fixing means.

17. Automatic cross-wound bobbin winding machine according to claim 1, wherein said at least one end frame includes a front end frame and a rear end frame, said at least one frame kit is in the form of a plurality of frame kits, and including at least one separable intermediate frame with halves, said front end frame, one of said frame kits and one half of one of said at least one separable intermediate frame as a side wall forming a pre-assembled structural assembly; and said rear end frame, another of said frame kits and one half of another of said at least one separable intermediate frame as a side wall forming another pre-assembled structural assembly; said pre-assembled structural assemblies being separately movable.

18. Automatic cross-wound bobbin winding machine according to claim 17, wherein a further one of said frame kits disposed between said one and said other frame kits and one half of two of said at least one intermediate frames as side walls form a further separately movable pre-assembled structural assembly.

19. Automatic cross-wound bobbin winding machine according to claim 17, wherein said frame assembly includes a spool holding assembly and at least one pre-readied fastening means and position-fixing means for holding said spool holding assembly.

20. Automatic cross-wound bobbin winding machine according to claim 19, wherein said at least one pre-readied fastening means and position-fixing means for holding said spool holding assembly is disposed on one of said frames.

21. Automatic cross-wound bobbin winding machine according to claim 19, including at least one blower assembly, said frame assembly having at least one pre-readied fastening means and position-fixing means holding said blower assembly.

22. Automatic cross-wound bobbin winding machine according to claim 21, wherein said at least one pre-readied fastening means and position-fixing means holding said blower assembly are disposed on one of said frames.

23. Automatic cross-wound bobbin winding machine according to claim 21, wherein said blower assembly includes a movable blower unit and supporting units.

24. Automatic cross-wound bobbin winding machine according to claim 23, wherein each of said supporting units includes at least one vertical support element and one horizontal beam.

25. Automatic cross-wound bobbin winding machine according to claim 23, including a front of the machine, said blower unit of said blower assembly having blower nozzles discharging overhead and aiming a blown air curtain at said front of the machine.

26. Automatic cross-wound bobbin winding machine according to claim 24, wherein said cross-wound bobbin winding mechanism includes at least one movable automatic cross-wound bobbin changer as a further assembly, and said frame assembly has pre-readied guide means for said movable automatic cross-wound bobbin changer.

27. Automatic cross-wound bobbin winding machine according to claim 26, wherein said at least one frame kit has at least one traverse formed of sheet steel with a box-like profile, and said guide means include a rail joined to said upper traverse on which said bobbin changer travels and another guide rail joined to said horizontal beam of said supporting unit of said blower assembly.

28. Automatic cross-wound bobbin winding machine according to claim 1, wherein said structural units are divided into standard units that are identical for all models of the cross-wound bobbin winding machine and into apparatus units that are specific to a model type.

29. Automatic cross-wound bobbin winding machine according to claim 28, wherein said standard units include:

said yarn tensioner, a lower pivot nozzle for aspirating a lower yarn and subsequently placing the lower yarn into said yarn joining device, an upper pivot nozzle for aspirating an upper yarn and subsequently placing the upper yarn into said yarn joining device, a yarn waxing unit, a drive unit and a yarn knotting or splicing unit for said yarn joining device, a spool frame for a cross-wound bobbin, and a drive unit for said cross-wound bobbin winding mechanism and said spool frame.

30. Automatic cross-wound bobbin winding machine according to claim 28, wherein said apparatus units that are specific to a model type include:

a yarn knotting or splicing unit of said yarn joining device, a winding drum guiding the yarn and frictionally driving a cross-wound bobbin, and a yarn cleaner.

31. Automatic cross-wound bobbin winding machine according to claim 29, wherein said drive unit has a housing, said lower pivot nozzle has a pivot path extending from a yarn travel path below said yarn tensioner unit as far as a point above said knotting or splicing unit of said yarn joining device, and said lower pivot nozzle has a pivot arm with a pivoting plane located between said housing of said drive unit and said splicing or knotting unit.

32. Automatic cross-wound bobbin winding machine according to claim 29, wherein said drive unit has a housing, and said yarn waxing unit is mounted on said housing of said drive unit above said yarn joining device and has a drive device for a roll of paraffin.

33. Automatic cross-wound bobbin winding machine according to claim 32, wherein said cross-wound bobbin winding mechanism has a drive unit with its own drive motor mounted on said housing of said drive unit.

34. Automatic cross-wound bobbin winding machine according to claim 33, wherein said drive device has a drive motor, said supporting frame has at least one multi-contact outlet for each winding device, and said drive unit has at least one multi-contact plug for supplying electrical energy to said drive motors.

35. Automatic cross-wound bobbin winding machine according to claim 29, wherein said apparatus units include a yarn cleaner disposed in a yarn path between said yarn tensioner and said yarn waxing unit above said yarn joining device.

36. Automatic cross-wound bobbin winding machine according to claim 29, wherein said apparatus units include a yarn cleaner, said yarn waxing unit has outer ends, said upper pivot nozzle has a pivot path extending from a position located near a cross-wound bobbin as far as a point below said knotting or splicing unit of said yarn joining device, and said upper pivot nozzle has a pivot arm with a pivot plane located in front of said outer ends of said yarn waxing unit, said knotting or splicing unit and said yarn cleaner.

37. Automatic cross-wound bobbin winding machine according to claim 29, wherein said drive unit has a housing on which a suction air distributor is disposed, said pivot nozzles being connected to said suction air distributor, and including a yarn catching nozzle connected to said suction air distributor above said yarn waxing unit.

38. Automatic cross-wound bobbin winding machine according to claim 37, wherein said frame kit includes a conduit section for each winding device having a connection element, and including a coupling tube connecting said suction air distributor of said drive unit to one of the connection elements at a time.

39. Automatic cross-wound bobbin winding machine according to claim 29, wherein said apparatus units include a winding drum guiding the yarn and frictionally driving a cross-wound bobbin, and said drive unit has respective gears each driving one of said yarn drum, said upper and lower pivot nozzles, said yarn tensioner and said yarn waxing unit.

40. Automatic cross-wound bobbin winding machine according to claim 1, wherein said drive unit has a lower housing portion, and said yarn tensioner is mounted on said lower housing portion below said yarn joining device and has a yarn disk brake with at least one brake disk driven by a drive device.

41. Automatic cross-wound bobbin winding machine according to claim 1, wherein said frame kit has a compressed air distributor device, and said yarn joining device has at least one detachable coupling device connected to said compressed air distributor device.

42. Automatic cross-wound bobbin winding machine, comprising a supporting frame, a plurality of winding devices secured on said supporting frame, each of said winding devices including pre-assembled modular structural units each having individual parts in the form of at least a yarn run-off location for a run-off spool, a yarn tensioner, a yarn joining device, and a cross-wound bobbin winding mechanism, a plurality of said structural units being combined into standardized or model-specific pre-assembled structural assemblies, each of said structural units and each of said structural assemblies having at least one of pre-readied fastening means, position-fixing means and couplings for energy supply means for interchangeable clamping to an adjacent structural unit or structural assembly in an accurate position, each of said winding devices also including one yarn take-up assembly and one yarn feed assembly, said support frame being in the form of a structural frame assembly having at least one end frame as a first structural unit and at least one frame kit supporting said winding devices as a second structural unit, said yarn take-up assembly having a pre-assembled drive unit with at least one wide and at least one narrow side, and said structural units being detachably secured to one of said at least one wide side of said drive unit, said structural units being divided into standard units that are identical for all models of the cross-wound bobbin winding machine and into apparatus units that are specific to a model type; said standard units including said yarn tensioner, a lower pivot nozzle for aspirating a lower yarn and subsequently placing the lower yarn into said yarn joining device, an upper pivot nozzle for aspirating an upper yarn and subsequently placing the upper yarn into said yarn joining device, a yarn waxing unit, a drive unit and a yarn knotting or splicing unit for said yarn joining device, a spool frame for a cross-wound bobbin, and a drive unit for said cross-wound bobbin winding mechanism and said spool frame; and said apparatus units including a winding drum guiding the yarn and frictionally driving a cross-wound bobbin, and a yarn eyelet disposed above said yarn waxing unit, located approximately 25–35 cm from the central axis of said winding drum and having a center disposed approximately 10 mm from the center of said winding drum.

43. Automatic cross-wound bobbin winding machine according to claim 42, wherein said yarn eyelet is located far enough from said winding drum that a yarn jigging triangle forming during winding between said yarn eyelet and said winding drum has an opening angle of a maximum of 45°.

44. Automatic cross-wound bobbin winding machine according to claim 43, wherein at least one vibration-damping surface in contact with the yarn is disposed in the plane of said yarn jigging triangle forming during winding between said yarn eyelet and said winding drum.

45. Automatic cross-wound bobbin winding machine according to claim 44, including a fork with two sides through which the jigging yarn runs, said vibration-damping surface being disposed on both sides of said fork.

46. Automatic cross-wound bobbin winding machine, comprising a supporting frame, a plurality of winding devices secured on said supporting frame, each of said winding devices including pre-assembled modular structural units each having individual parts in the form of at least a yarn run-off location for a run-off spool, a yarn tensioner, a yarn joining device, and a cross-wound bobbin winding mechanism, a plurality of said structural units being combined into standardized or model-specific pre-assembled structural assemblies, each of said structural units and each of said structural assemblies having at least one of pre-readied fastening means, position-fixing means and couplings for energy supply means for interchangeable clamping to an adjacent structural unit or structural assembly in an accurate position, each of said winding devices also including one yarn take-up assembly and one yarn feed assembly, said support frame being in the form of a structural frame assembly having a front end frame and a rear end frame as a first structural unit and a plurality of frame kits supporting said winding devices as a second structural unit, at least one separable intermediate frame with halves; said front end frame, one of said frame kits and one half of one of said at least one separable intermediate frame as a side wall forming a pre-assembled structural assembly; and said rear end frame, another of said frame kits and one half of another of said at least one separable intermediate frame as a side wall forming another pre-assembled structural assembly; said pre-assembled structural assemblies being separately movable, said frame assembly including a spool holding assembly and at least one of pre-readied fastening means and position-fixing means for holding said spool holding assembly, and at least one blower assembly, said frame assembly having at least one of pre-readied fastening means and position-fixing means holding said blower assembly, said blower assembly including a movable blower unit and supporting units, each of said supporting units including at least one vertical support element and one horizontal beam, said cross-wound bobbin winding mechanism including at least one movable automatic cross-wound bobbin changer as a further assembly, said frame assembly having pre-readied guide means for said movable automatic cross-wound bobbin changer, and said blower unit being combined with said cross-wound bobbin changer to form a common structural assembly.

* * * * *